US008978258B2

(12) United States Patent
Patel et al.

(10) Patent No.: US 8,978,258 B2
(45) Date of Patent: Mar. 17, 2015

(54) RAZOR HANDLE WITH A ROTATABLE PORTION

(75) Inventors: Ashok Bakul Patel, Needham, MA (US); Emma Keeling, Reading (GB); Matthew Frank Murgida, Somerville, MA (US); Robert Harold Johnson, Hingham, MA (US)

(73) Assignee: The Gillette Company, Boston, MA (US)

( * ) Notice: Subject to any disclaimer, the term of this patent is extended or adjusted under 35 U.S.C. 154(b) by 420 days.

(21) Appl. No.: 13/439,898

(22) Filed: Apr. 5, 2012

(65) Prior Publication Data

US 2012/0255185 A1 Oct. 11, 2012

Related U.S. Application Data

(60) Provisional application No. 61/471,943, filed on Apr. 5, 2011.

(51) Int. Cl.
*B26B 21/52* (2006.01)
*B26B 21/40* (2006.01)

(52) U.S. Cl.
CPC ..... *B26B 21/4093* (2013.01); *B26B 21/52* (2013.01); *B26B 21/521* (2013.01)
USPC ..... 30/527

(58) Field of Classification Search
CPC .... B26B 21/52; B26B 21/521; B26B 21/523; B25G 3/00; B25G 3/38
USPC ..... 30/47–51, 526–533
See application file for complete search history.

(56) References Cited

U.S. PATENT DOCUMENTS

| | | | | | |
|---|---|---|---|---|---|
| 3,935,639 | A | * | 2/1976 | Terry et al. | 30/47 |
| 4,152,828 | A | | 5/1979 | Lund | |
| 4,879,811 | A | * | 11/1989 | Cooney | 30/527 |
| 4,955,136 | A | * | 9/1990 | Diaz-Rivera | 30/50 |
| 5,029,391 | A | | 7/1991 | Althaus et al. | |
| 5,033,152 | A | | 7/1991 | Althaus | |
| 5,050,301 | A | * | 9/1991 | Apprille, Jr. | 30/529 |
| 5,070,614 | A | | 12/1991 | Hardin et al. | |
| 5,526,568 | A | | 6/1996 | Copelan | |
| 5,535,518 | A | | 7/1996 | Althaus | |

(Continued)

FOREIGN PATENT DOCUMENTS

| | | | |
|---|---|---|---|
| EP | 1136197 | | 9/2001 |
| WO | WO 2009154921 | A2 * | 12/2009 |

(Continued)

OTHER PUBLICATIONS

European Search Report for EP 12163353.1-2313 dated Jul. 10, 2012.

*Primary Examiner* — Jason Daniel Prone
(74) *Attorney, Agent, or Firm* — Kevin C. Johnson; Steven W. Miller

(57) ABSTRACT

A razor includes a cartridge having a blade, the cartridge configured to rotate about a first axis, and a handle coupled to the cartridge. The handle includes a first end, a second end opposite the first end, and a rotatable portion coupled to the second end such that the rotatable portion is configured to rotate relative to the first end and about a second axis. The rotatable portion includes a base and a retention system. The retention system is configured to apply a resistance torque upon the rotatable portion when the rotatable portion is rotated from an at rest position.

18 Claims, 17 Drawing Sheets

(56) References Cited

U.S. PATENT DOCUMENTS

| | | | | |
|---|---|---|---|---|
| 5,560,106 | A | 10/1996 | Armbruster et al. | |
| 5,678,316 | A | 10/1997 | Althaus et al. | |
| 6,115,924 | A | 9/2000 | Oldroyd | |
| 6,223,442 | B1 * | 5/2001 | Pina | 30/527 |
| 6,311,400 | B1 | 11/2001 | Hawes et al. | |
| 6,381,857 | B1 | 5/2002 | Oldroyd | |
| 6,434,828 | B1 * | 8/2002 | Andrews | 30/50 |
| 6,615,498 | B1 | 9/2003 | King et al. | |
| 6,973,730 | B2 | 12/2005 | Tomassetti et al. | |
| 7,140,116 | B2 | 11/2006 | Coffin | |
| 7,200,942 | B2 * | 4/2007 | Richard | 30/526 |
| 7,363,715 | B2 * | 4/2008 | Coffin et al. | 30/531 |
| 7,685,720 | B2 | 3/2010 | Efthimiadis et al. | |
| 7,730,619 | B2 * | 6/2010 | Ozenick | 30/50 |
| 7,877,879 | B2 | 2/2011 | Nakasuka | |
| 7,895,754 | B2 | 3/2011 | Blackburn | |
| 7,913,393 | B2 | 3/2011 | Royle et al. | |
| 7,937,837 | B2 | 5/2011 | Psimadas et al. | |
| 7,971,363 | B2 | 7/2011 | Nakasuka | |
| 8,024,863 | B2 | 9/2011 | Wain | |
| 8,033,022 | B2 | 10/2011 | Ben-Ari | |
| 8,033,023 | B2 | 10/2011 | Johnson et al. | |
| 8,061,041 | B2 | 11/2011 | Jessemey et al. | |
| 8,065,802 | B2 | 11/2011 | Oglesby et al. | |
| 8,079,147 | B2 | 12/2011 | Wonderley | |
| 8,151,466 | B2 | 4/2012 | Putzer | |
| 8,151,472 | B2 | 4/2012 | Dimitris et al. | |
| 8,166,658 | B2 | 5/2012 | Nakasuka | |
| 8,166,661 | B2 | 5/2012 | King | |
| 8,205,343 | B2 | 6/2012 | Winter et al. | |
| 8,205,344 | B2 | 6/2012 | Stevens | |
| 8,234,789 | B2 | 8/2012 | Avens et al. | |
| 8,261,451 | B2 | 9/2012 | Macove | |
| 8,286,354 | B2 | 10/2012 | Walker, Jr. et al. | |
| 8,745,882 | B2 * | 6/2014 | Murgida et al. | 30/527 |
| 8,745,883 | B2 * | 6/2014 | Murgida et al. | 30/527 |
| 2009/0313837 | A1 | 12/2009 | Winter et al. | |
| 2010/0132204 | A1 | 6/2010 | Brown | |
| 2010/0154221 | A1 | 6/2010 | De Benedetto et al. | |
| 2010/0313426 | A1 | 12/2010 | Royle | |
| 2011/0010943 | A1 | 1/2011 | Izumi | |
| 2011/0023305 | A1 | 2/2011 | Whelan et al. | |
| 2011/0035950 | A1 | 2/2011 | Royle | |
| 2011/0067245 | A1 | 3/2011 | Bridges et al. | |
| 2011/0088268 | A1 | 4/2011 | Marut | |
| 2011/0138637 | A1 | 6/2011 | Bucco | |
| 2011/0146080 | A1 | 6/2011 | Pauw | |
| 2011/0167641 | A1 | 7/2011 | Brada et al. | |
| 2011/0167653 | A1 | 7/2011 | Psimadas et al. | |
| 2011/0173821 | A1 | 7/2011 | Hage et al. | |
| 2011/0225826 | A1 | 9/2011 | Leventhal | |
| 2011/0239475 | A1 | 10/2011 | Efthimiadis et al. | |
| 2011/0247217 | A1 | 10/2011 | Johnson et al. | |
| 2011/0277326 | A1 | 11/2011 | Bodet | |
| 2011/0308089 | A1 | 12/2011 | Bridges | |
| 2012/0047754 | A1 | 3/2012 | Schmitt | |
| 2012/0060382 | A1 | 3/2012 | Beugels et al. | |
| 2012/0073149 | A1 | 3/2012 | Murgida et al. | |
| 2012/0073150 | A1 | 3/2012 | Murgida et al. | |
| 2012/0084984 | A1 | 4/2012 | Davis | |
| 2012/0096718 | A1 | 4/2012 | Howell et al. | |
| 2012/0096722 | A1 | 4/2012 | Howell et al. | |
| 2012/0096723 | A1 | 4/2012 | Howell et al. | |
| 2012/0124840 | A1 | 5/2012 | Iaccarino et al. | |
| 2012/0198698 | A1 | 8/2012 | Szczepanowski et al. | |
| 2012/0233868 | A1 | 9/2012 | Bridges et al. | |
| 2012/0255185 | A1 | 10/2012 | Patel et al. | |
| 2012/0260509 | A1 | 10/2012 | Fang et al. | |
| 2012/0291295 | A1 | 11/2012 | Braun | |
| 2012/0297625 | A1 | 11/2012 | Madden | |

FOREIGN PATENT DOCUMENTS

| | | | |
|---|---|---|---|
| WO | WO-2011/094887 | A1 | 8/2011 |
| WO | WO 2011/131945 | A1 | 10/2011 |
| WO | WO-2012/157624 | A1 | 11/2012 |
| WO | WO-2012/158143 | A1 | 11/2012 |
| WO | WO-2012/161449 | A2 | 11/2012 |

* cited by examiner

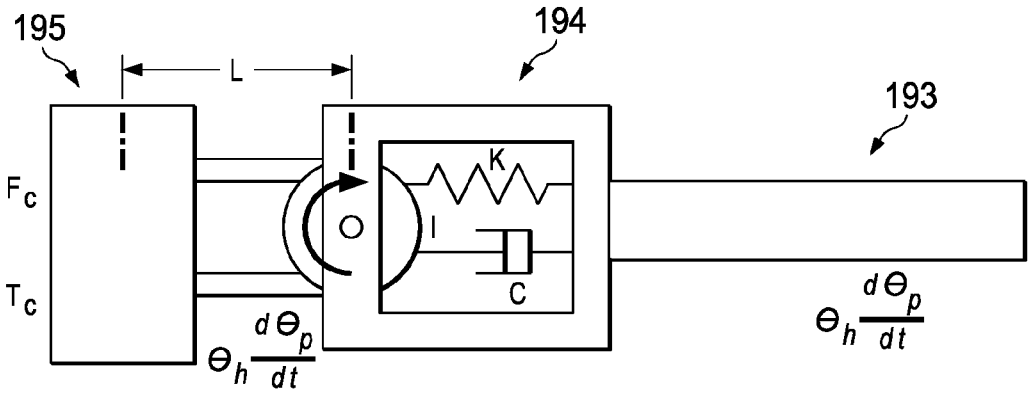
FIG. 14
FIG. 15A
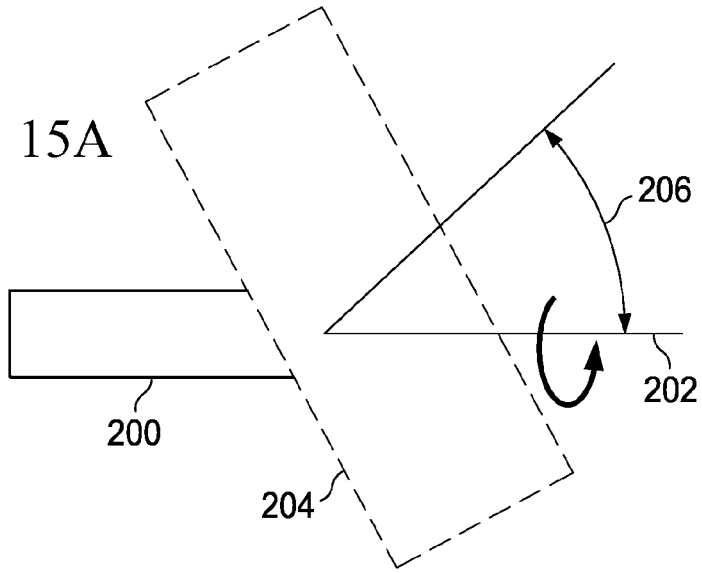

FIG. 16
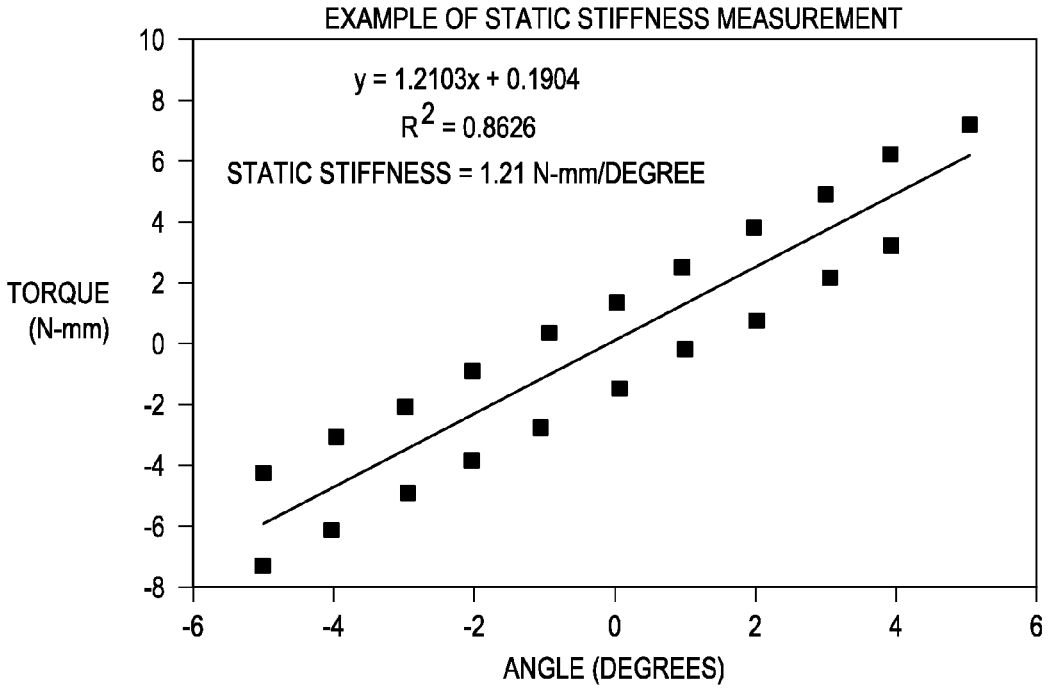
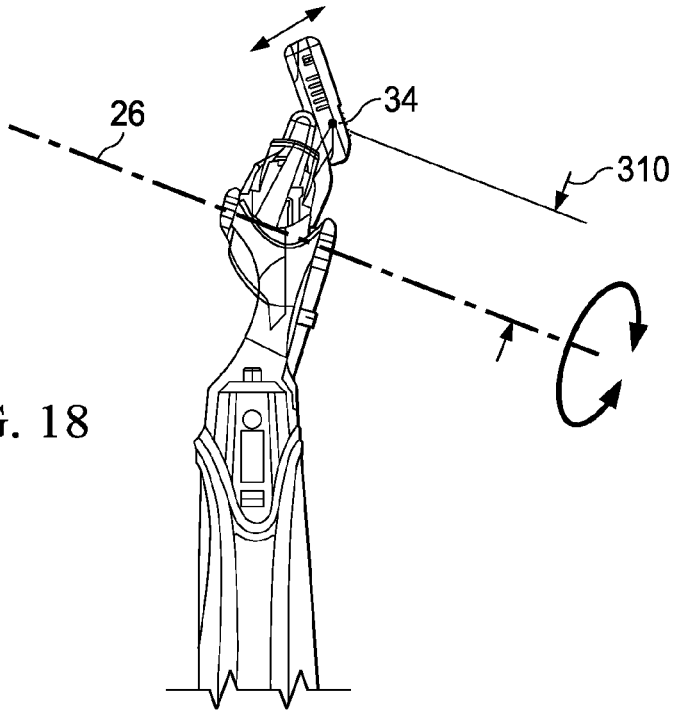
FIG. 18

RAZOR HANDLE WITH A ROTATABLE PORTION

CROSS REFERENCE TO RELATED APPLICATION(S)

This application claims priority to U.S. Provisional Application No. 61/471,943, filed Apr. 5, 2011, the subject of which is hereby incorporated by reference in its entirety.

FIELD OF THE INVENTION

The invention generally relates to handles for razors, more particularly to handles with a rotatable portion.

BACKGROUND OF THE INVENTION

Recent advances in shaving razors, such as a 5-bladed or 6-bladed razor for wet shaving, may provide for closer, finer, and more comfortable shaving. One factor that may affect the closeness of the shave is the amount of contact for blades on a shaving surface. The larger the surface area that the blades contact then the closer the shave becomes. Current approaches to shaving largely comprise of razors with only a single axis of rotation, for example, about an axis substantially parallel to the blades and substantially perpendicular to the handle (i.e., front-and-back pivoting motion). The curvature of various shaving areas and direction of hair, however, do not simply conform to a single axis of rotation and, thus, a portion of the blades often disengage from the skin or transfer relatively less pressure onto the skin during shaving as they have limited ability to pivot about the single axis. Therefore, blades on such razors may only have limited surface contact with certain shaving areas, such as under the chin, around the jaw line, around the mouth, etc.

Razors with multiple axes of rotation may help in addressing closeness of shaving and in more closely following skin contours of a user. For example, a second axis of rotation for a razor can be an axis substantially perpendicular to the blades and substantially perpendicular to the handle, such as side-to-side pivoting motion. Examples of various approaches to shaving razors with multiple axes of rotation are described in Canadian Patent No. 1045365; U.S. Pat. Nos. 5,029,391; 5,093,991; 5,526,568; 5,560,106; 5,787,593; 5,953,824; 6,115,924; 6,381,857; 6,615,498; and 6,880,253; U.S. Patent Application Publication Nos. 2009/066218; 2009/0313837; 2010/0043242; and 2010/0083505; and Japanese Patent Laid Open Publication Nos. H2-34193; H2-52694; and H4-22388. However, to provide another axis of rotation, such as an axis substantially perpendicular to the blades and substantially perpendicular to the handle; typically, additional parts are implemented with increased complexity and movement and include components that may be prone to fatigue, deformation, stress relaxation, or creep under certain conditions of use and storage. Furthermore, these additional components often require tight tolerances with little room for error. As a result, current approaches introduce complexities, costs, and durability issues for manufacturing, assembling, and using razors with multiple axes of rotation.

What is needed, then, is a razor, suitable for wet or dry shaving, with multiple axes of rotation, for example, an axis substantially perpendicular to the blades and substantially perpendicular to the handle and an axis substantially parallel to the blades and substantially perpendicular to the handle. The razor, including powered and manual razors, is preferably simpler, cost-effective, reliable, durable, easier and/or faster to manufacture, and easier and/or faster to assemble with more precision.

SUMMARY OF THE INVENTION

In an aspect of the present invention, a razor comprises a cartridge comprising a blade, in which the cartridge configured to rotate about a first axis, and a handle coupled to the cartridge. The handle comprises a first end, a second end opposite the first end, and a rotatable portion coupled to the second end such that the rotatable portion is configured to rotate relative to the first end and about a second axis. The rotatable portion comprises a base and a retention system, in which the retention system is configured to apply a resistance torque upon the rotatable portion when the rotatable portion is rotated from an at rest position. A distance between the first axis and the second axis defines a moment arm and the retention system has a static stiffness as determined by the Static Stiffness Method such that a ratio of the static stiffness to the moment arm is about 0.05 N/degree to about 1.2 N/degree.

This aspect can include any one or more of the following embodiments. The retention system can comprise a cantilever tail extending from the base, a distal end of the cantilever tail loosely retained by a frame of the handle, such that cantilever tail generates said torque upon rotation of the rotatable portion about the second axis. The frame can define at least one aperture therethrough and the base can comprise at least one projection extending therefrom, in which the at least one aperture of the frame can be configured to receive the at least one projection of the base to couple the rotatable portion to the frame such that the at least one projection can rotate in the at least one aperture so that the rotatable portion can rotate about the second axis. The frame further comprises at least one wall loosely retaining the distal end of the cantilever tail. The at least one wall can comprise a first wall and a second wall that are offset such that the first wall and the second wall are substantially parallel and non-coplanar. The cradle, the first wall, and the second wall are integrally formed. The retention system can comprise stainless steel. The moment arm can be about 13 mm to about 15 mm. The ratio can be about 0.085 N/degree.

In yet another aspect, a razor comprises a cartridge comprising a blade, in which the cartridge configured to rotate about a first axis, and a handle coupled to the cartridge. The handle comprises a first end, a second end opposite the first end. And a rotatable portion coupled to the second end such that the rotatable portion is configured to rotate relative to the first end and about a second axis, such that the rotatable portion comprises a base and a retention system and such that the retention system is configured to apply a resistance torque upon the rotatable portion when the rotatable portion is rotated from an at rest position. A distance between the first axis and the second axis defines a moment arm and the rotatable portion has a damping value as determined by the Pendulum Test Method such that a ratio of the damping value to the moment arm is about 0.0005 N*sec/degree to about 0.02 N*sec/degree and the retention system has a static stiffness as determined by the Static Stiffness Method such that a ratio of the static stiffness to the moment arm is about 0.05 N/degree to about 1.2 N/degree.

This aspect can also include one or more of the following embodiments. The ratio of the static stiffness to the moment arm can be about 0.085 N/degree. A ratio of an inertia of the rotatable portion to the moment arm can be about 0.013 kg-mm to about 0.067 kg-mm. The retention system can comprise a cantilever tail extending from the base, a distal end of the cantilever tail loosely retained by a frame of the handle, such that the cantilever tail generates said torque upon rotation of the rotatable portion about the second axis. The frame can define at least one aperture therethrough in which the base comprises at least one projection extending therefrom, the at least one aperture of the frame configured to receive the at least one projection of the base to couple the rotatable portion to the frame such that the at least one projection can rotate in the at least one aperture so that the rotatable portion can rotate about the second axis. The frame can further comprise at least one wall loosely retaining the distal end of the cantilever tail. The at least one wall can comprise a first wall and a second wall that are offset such that the first wall and the second wall are substantially parallel and non-coplanar. The cradle, the first wall, and the second wall can be integrally formed. The retention system can comprise stainless steel. The moment arm can be about 13 mm to about 15 mm.

In still another aspect, a razor comprises a cartridge comprising a blade, in which the cartridge configured to rotate about a first axis, and a handle coupled to the cartridge. The handle comprises a first end, a second end opposite the first end. And a rotatable portion coupled to the second end such that the rotatable portion is configured to rotate relative to the first end and about a second axis, such that the rotatable portion comprises a base and a retention system and such that the retention system is configured to apply a resistance torque upon the rotatable portion when the rotatable portion is rotated from an at rest position. A distance between the first axis and the second axis defines a moment arm and the retention system has a static stiffness as determined by the Static Stiffness Method such that a ratio of the static stiffness to the moment arm is about 0.05 N/degree to about 1.2 N/degree and a ratio of an inertia of the rotatable portion to the moment arm is about 0.013 kg-mm to about 0.067 kg-mm.

In one embodiment, the invention comprises a handle having a retention system comprising a static stiffness of about 0.7 N*mm/deg to about 2.25 Nmm/deg as determined by at least one of the Static Stiffness Test, and a damping of from about 0.015 N*mm*sec/degree to about 0.30 N*mm*sec/degree as determined by the Pendulum Test Method. In another embodiment, a handle having a retention system comprising a static stiffness of about 0.7 Nmm/deg to about 2.25 Nmm/deg as determined by at least one of the Static Stiffness Test, and a pod inertias range from about 0.2 kg-mm$^2$ to about 1 kg-mm$^2$ or a total inertia of the cartridge-pod combination range from about 0.7 kg-mm$^2$ to about 3.5 kg-mm$^2$. Without intending to be bound by theory, it is now believed that handles having such retention systems can provide a desirable dynamic response during shaving such that as the cartridge is rotated about the first axis of rotation the return torque or force bringing it back to an at rest position is acceptable by a user.

BRIEF DESCRIPTION OF THE DRAWINGS

Other features and advantages of the present invention, as well as the invention itself, can be more fully understood from the following description of the various embodiments, when read together with the accompanying drawings, in which:

FIG. 14 is a simplified diagram of a handle for a shaving razor showing the various elements used in the formula for Equation A, provided herein;

FIGS. 15A and 15B are a simplified diagram of a top view and a sample perspective view, respectively, of a set up for conducting the Static Stiffness Method;

FIG. 16 is a graph showing torque vs. degree of rotation as measured using the Static Stiffness Method on a handle in accordance with the present invention;

FIG. 18 is a schematic side view of a shaving razor showing the various elements used to calculate the moment arm;

DETAILED DESCRIPTION OF THE INVENTION

Except as otherwise noted, the articles "a," "an," and "the" mean "one or more."

Figure 1:
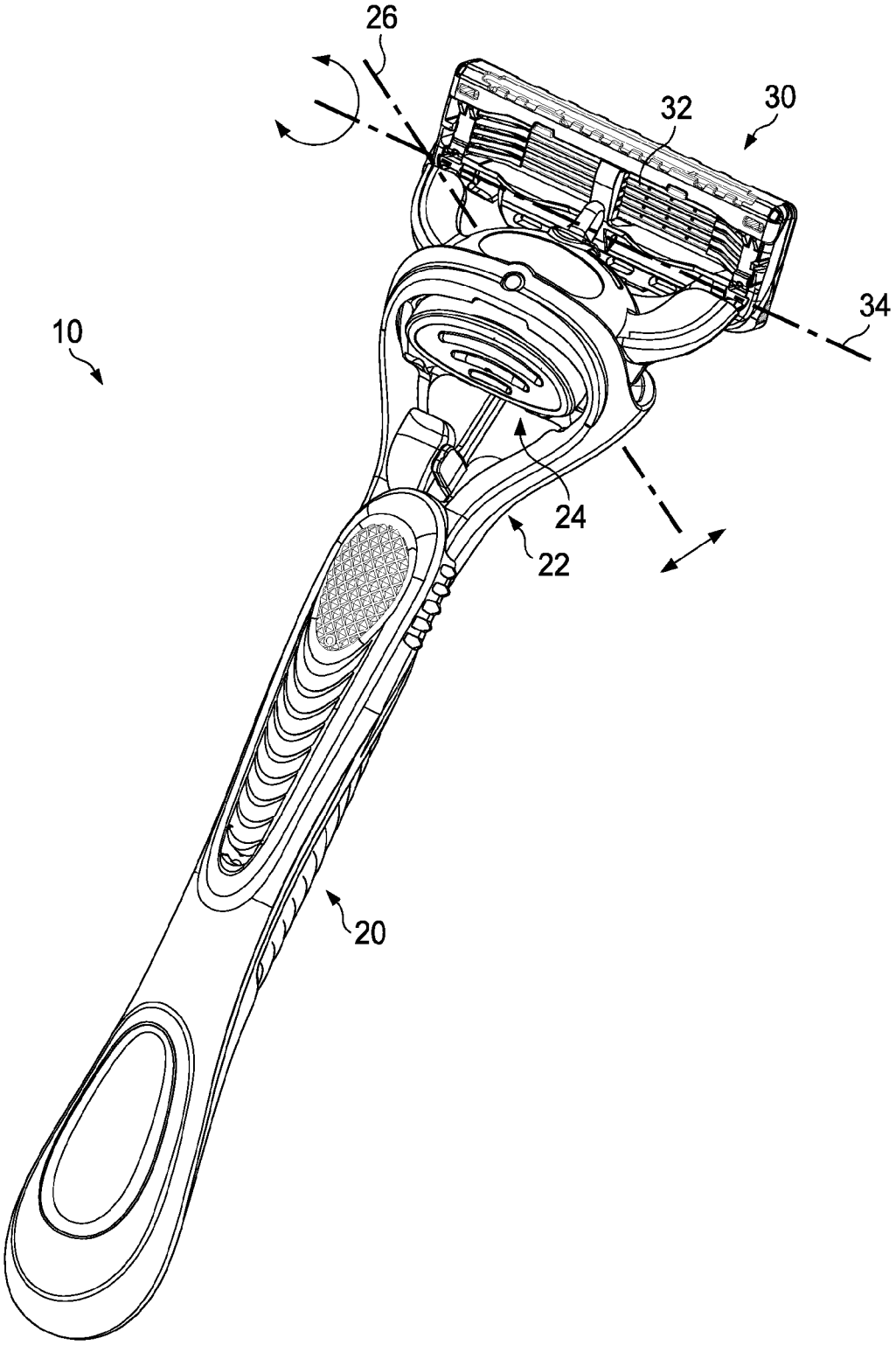
FIG. 1 is a schematic perspective view of a rear of a shaving razor in accordance with an embodiment of the invention.
Figure 2:
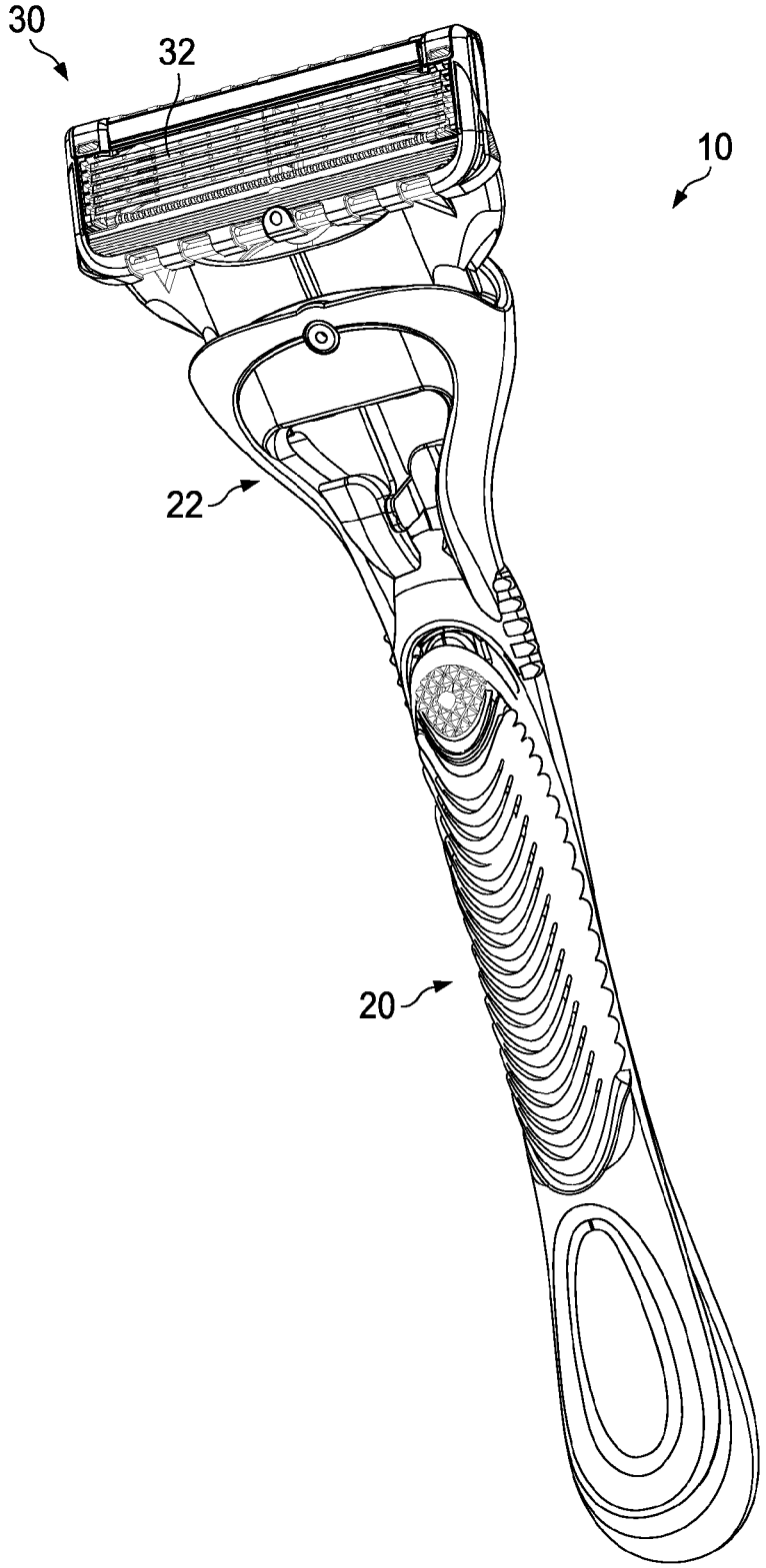
FIG. 2 is a schematic perspective view of a front of the shaving razor of FIG. 1.

Referring to FIGS. 1 and 2, a shaving razor 10 of the present invention comprises a handle 20 and a blade cartridge unit 30, which removably connects or releasably attaches to the handle 20 and contains one or more blades 32. The handle 20 comprises a frame 22 and a blade cartridge connecting assembly 24 operably coupled thereto such that the blade cartridge connecting assembly 24 is configured to rotate about an axis of rotation 26 that is substantially perpendicular to the blades 32 and substantially perpendicular to the frame 22. The blade cartridge unit 30 is configured to rotate about an axis of rotation 34 that is substantially parallel to the blades 32 and substantially perpendicular to the handle 20. Nonlimiting examples of suitable blade cartridge units are described in U.S. Pat. No. 7,168,173. When the blade cartridge unit 30 is attached to the handle 20 via the blade cartridge connecting assembly 24, the blade cartridge unit 30 is configured to rotate about multiple axes of rotation, for example, a first axis of rotation 26 and a second axis of rotation 34.

Figure 3:
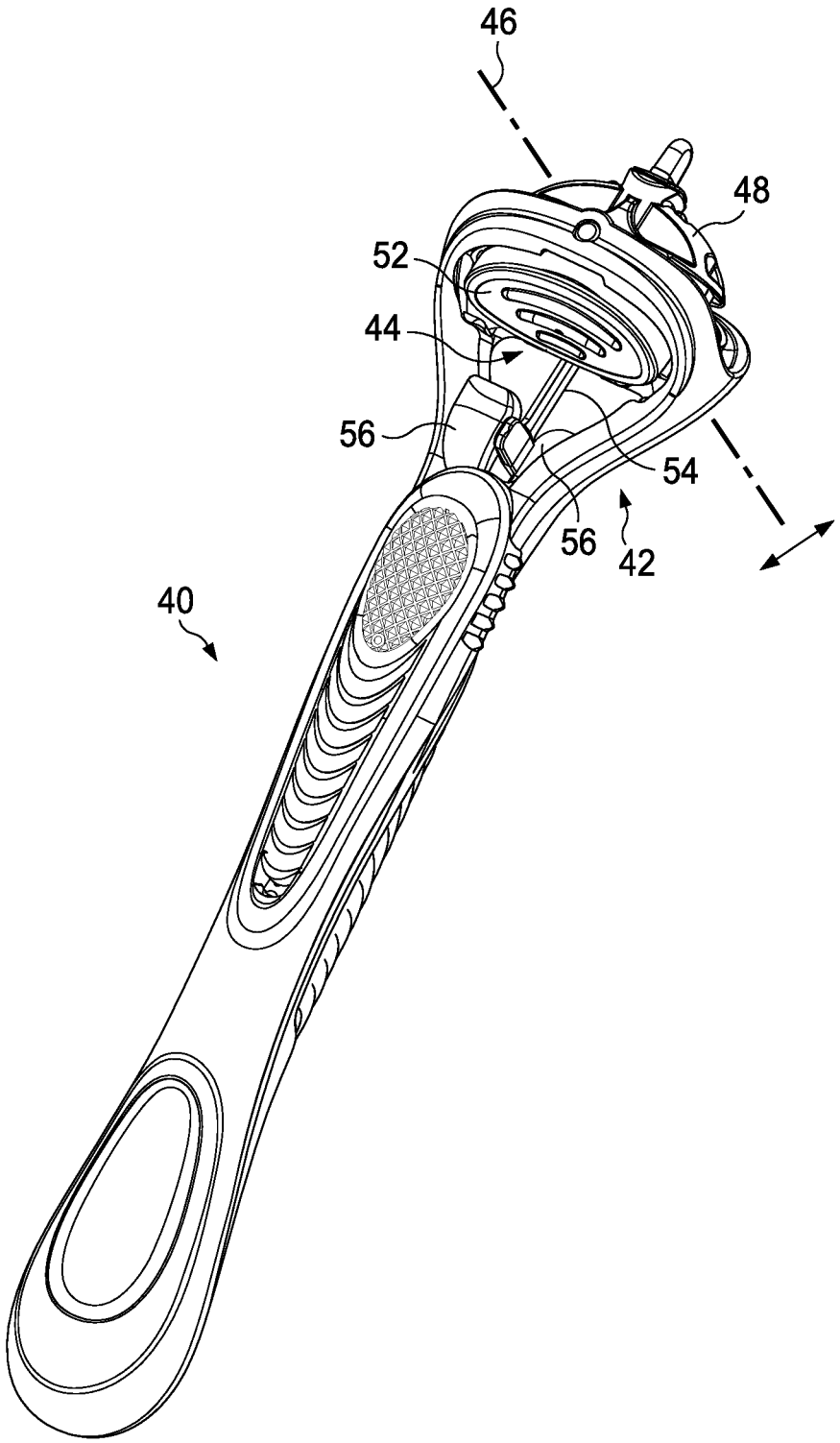
FIG. 3 is a schematic perspective view of a rear of a handle of a shaving razor according to an embodiment of the invention.
Figure 4:
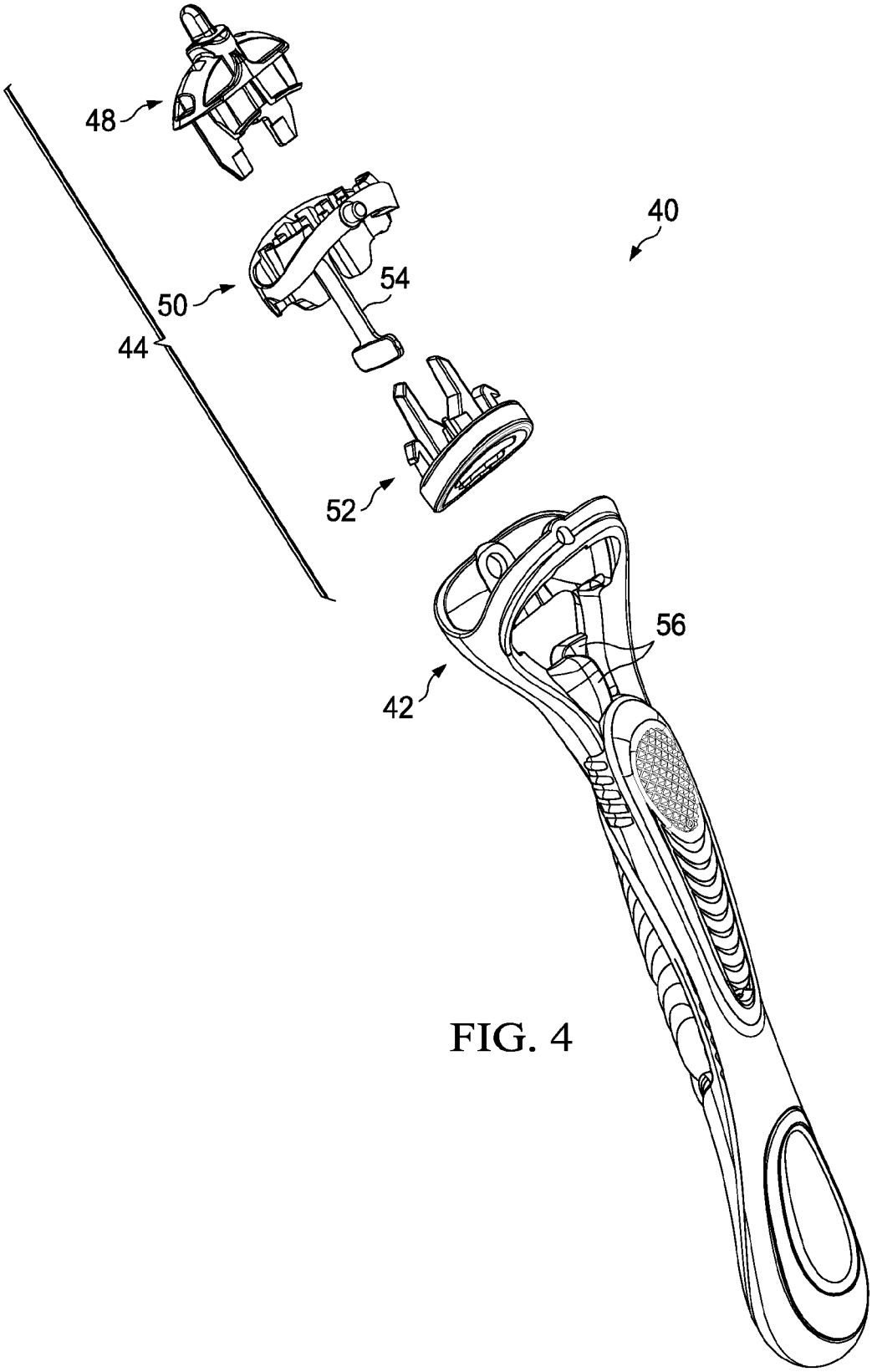
FIG. 4 is a schematic exploded perspective view of the handle of FIG. 3.
Figure 5:
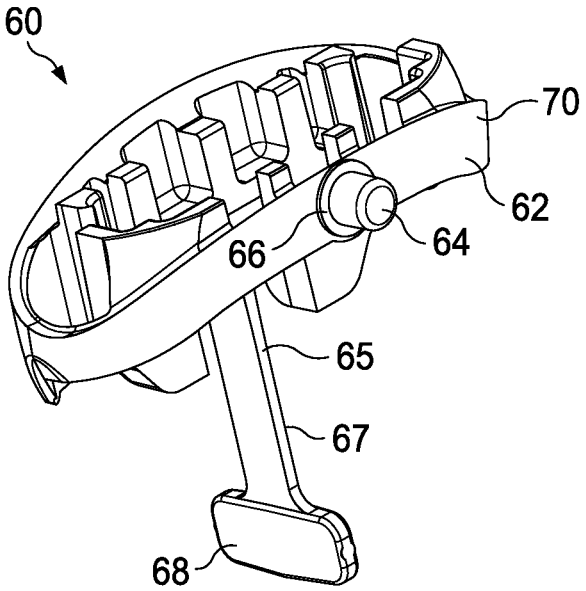
FIG. 5 is a schematic perspective view of a pod in accordance with an embodiment of the invention.
Figure 6:
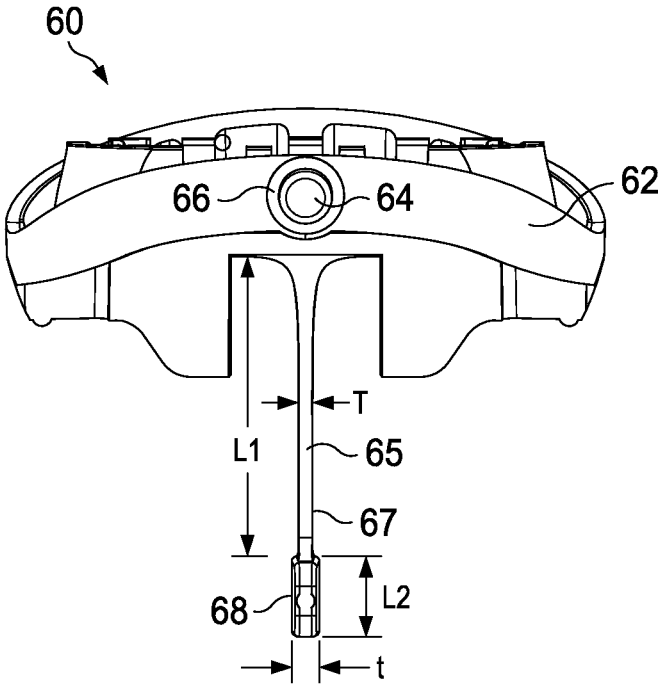
FIG. 6 is a schematic rear view of the pod of FIG. 5.
Figure 7:
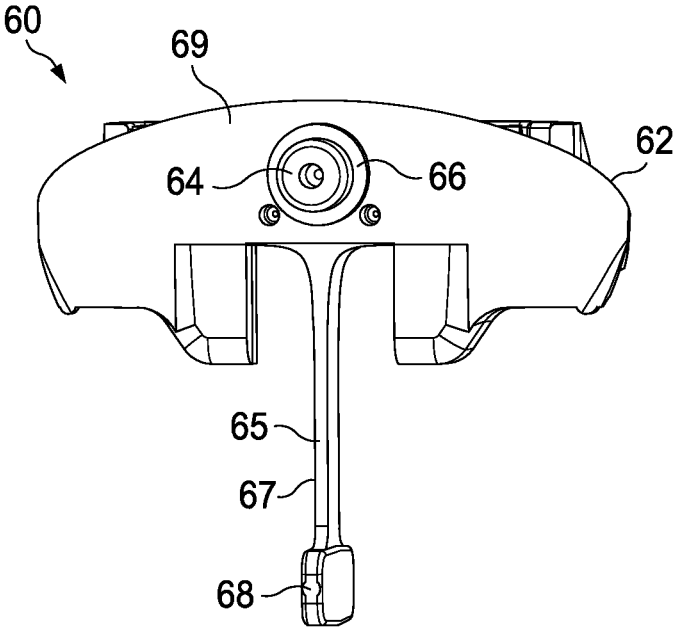
FIG. 7 is a schematic perspective view of a front of the pod of FIG. 5.
Figure 8:
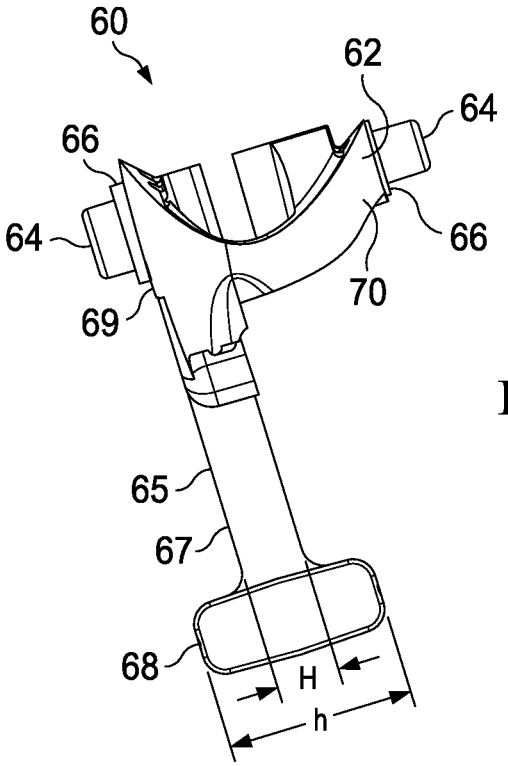
FIG. 8 is a schematic side view of the pod of FIG. 5.

FIGS. 3 and 4 depict an embodiment of a handle 40 of the present invention. The handle 40 comprises a frame 42 and a blade cartridge connecting assembly 44 operably coupled thereto such that the blade cartridge connecting assembly 44 is configured to rotate about an axis of rotation 46 that is substantially perpendicular to the frame 42. The blade cartridge connecting assembly 44 comprises a docking station 48 engageable with a blade cartridge unit (not shown), a pod 50, and an ejector button assembly 52. The pod 50 is operably coupled to the frame 42, such that it is rotatable relative to the frame 42, with the docking station 48 and the ejector button assembly 52 removably or releasably attached to the pod 50. Nonlimiting examples of suitable docking stations and ejector button assemblies are described in U.S. Pat. Nos. 7,168,173 and 7,690,122 and U.S. Patent Application Publication Nos. 2005/0198839, 2006/0162167, and 2007/0193042. In an embodiment, the pod 50 is flexible such that it is separable from the frame 42. The pod 50 comprises a cantilever tail 54 in which a distal end of the cantilever tail 54 is loosely retained by a pair of offset walls 56 of the frame 42. In an embodiment, the cantilever tail 54 can be retained by a pair of opposing walls or within a recessed channel of the frame. The cantilever tail 54 generates a return torque when the pod 50 is rotated about axis 46 such that the pod 50 is returned to an at rest position. Nonlimiting examples of suitable springs retained between walls to generate a return torque are described in U.S. Pat. Nos. 3,935,639, and 4,785,534 and shown by the Sensor® 3 disposable razors (available from the Gillette Co., Boston, Mass.).

FIGS. 5 through 8 depict a pod 60 of the present invention. The pod 60 comprises a base 62 with one or more projections 64 and a cantilever tail 65 extending therefrom. The projections 64 may extend from any exterior portion of the base 62. In an embodiment, the projections 64 are generally cylindrical. By "generally cylindrical" the projections 64 may include non-cylindrical elements, e.g., ridges, protrusions, or recesses, and/or may include regions along its length that are not cylindrical, such as tapered and/or flared ends due to manufacturing and design considerations. Additionally or alternatively, one or more of the projections 64 may include a bearing pad 66 of larger size between the projections 64 and the base 62. For example, each of the projections 64 may include a bearing pad 66 of larger size between the projections 64 and the base 62. In an embodiment, the cantilever tail 65 forms a substantially T-shaped configuration comprising an elongate stem 67 and a perpendicular bar 68 at a distal end. In an embodiment, the elongate stem 67 and the perpendicular bar 68 are each generally rectangular. By "generally rectangular" the elongate stem 67 and the perpendicular bar 68 may each include non-rectangular elements, e.g., ridges, protrusions, or recesses, and/or may include regions along its length that are not rectangular, such as tapered and/or flared ends due to manufacturing and design considerations. For example, a thickness (T) of the elongate stem 67 may gradually flare larger towards a proximal end of the elongate stem 67 relative to the base 62. Gradually flaring the thickness of the elongate stem 67 may help to reduce stress concentrations when the pod 60 is rotated so that yield stresses of the material of the elongate stem 67 will not be exceeded, which if exceeded would result in failure such as permanent deformation or fatigue with repeated use. Similarly, a height (H) of the elongate stem 67 may flare larger, e.g., gradually flare larger or quickly flare larger, towards a distal end of the elongate stem 67, as the elongate stem 67 approaches the perpendicular bar 68. In this arrangement, a length (L1) of the elongate stem 67 can be maximized to achieve desirable stiffnesses and return torques when the pod 60 is rotated. Alternatively, the elongate stem 67 and the perpendicular bar 68 may each form any geometric, polygonal, or arcuate shape, e.g., an ovoid shape. An interior of the pod 60 defines a hollow portion therethrough with two open ends, for example, a top end and a bottom end. Interior surfaces of the pod 60 may optionally include projections extending into the hollow portion, grooves, channels, and/or detents to engage corresponding mating shapes of a docking station at one end of the pod 60 and an ejector button assembly at another end of the pod 60. The cantilever tail 65 extends from a front portion 69 of the base 62, though the cantilever tail 66 may alternatively extend from a rear portion 70 of the base 62.

In the present invention, the pod 60 serves multiple functions. The pod 60 facilitates an axis of rotation in a razor handle, namely an axis of rotation substantially perpendicular to one or more blades when a razor is assembled and substantially perpendicular to a frame of a handle. When rotated from an at rest position, the pod 60 generates a return torque to return to the rest position by way of a spring member, such as a cantilever spring or a leaf spring. The return torque is generated by the cantilever tail 65 of the pod 60. For example, the return torque is generated by elongate stem 67 of the cantilever tail 65. The pod 60 also serves as a carrier for an ejector button assembly, a docking station, and/or a blade cartridge unit (e.g., via the docking station).

In an embodiment, the pod 60 is unitary and, optionally, formed from a single material. Additionally or alternatively, the material is flexible such that the entire pod 60 is flexible. Preferably, the pod 60 is integrally molded such that the cantilever tail 65, which comprises the elongate stem 67 and the perpendicular bar 68, and the base 62 are integrally formed. A unitary design ensures that the base 62 and the cantilever tail 65 are in proper alignment to each other. For example, the position of the cantilever tail 65 relative to an axis of rotation is then controlled, as well as the perpendicular orientation of the base 62 and the cantilever tail 65. Furthermore, the base 62 and the cantilever tail 65 do not separate upon drop impact.

Figure 9:
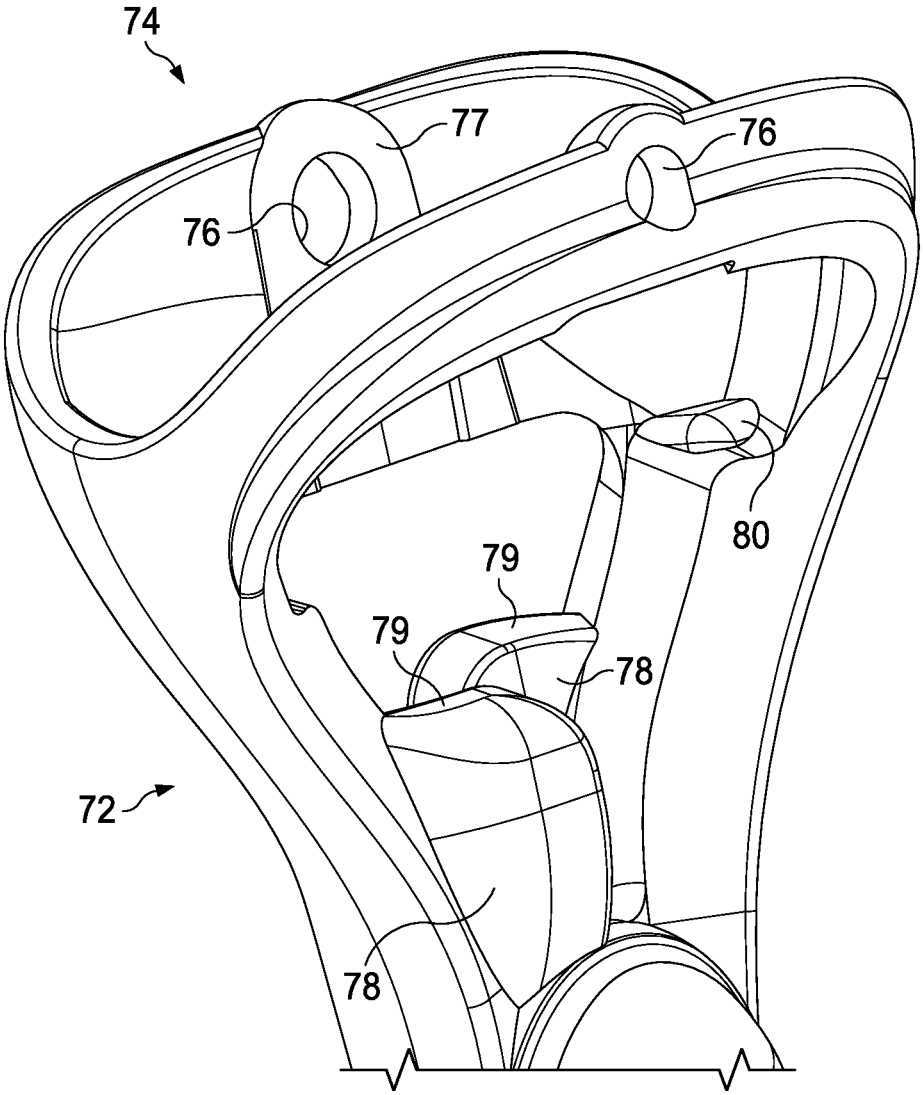
FIG. 9 is a schematic perspective view of a portion of a frame of a handle according to an embodiment of the invention.
Figure 10A:
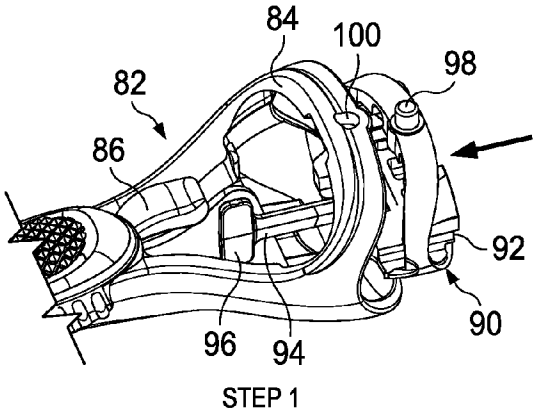
FIGS. 10A-10E depict a procedure for assembling a portion of a handle according to an embodiment of the invention.
Figure 10B:
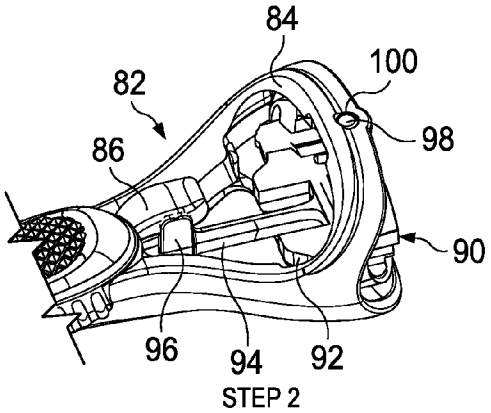
Figure 10C:
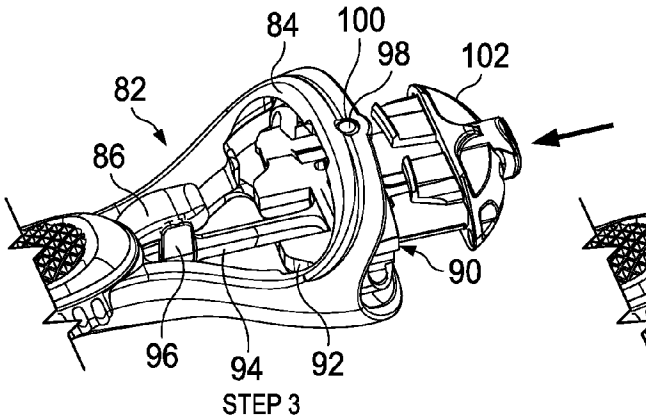
Figure 10D:
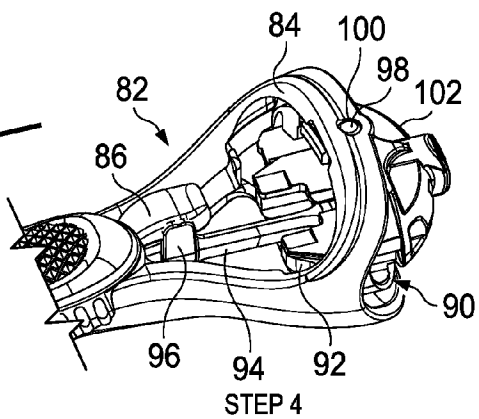
Figure 10E:
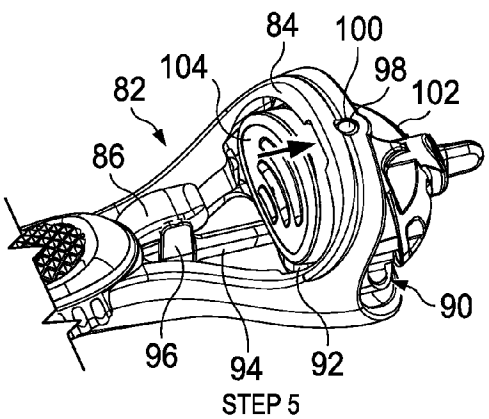

Referring now to FIG. 9, a portion of a frame 72 of a handle comprises a cradle 74 and one or more apertures 76 defined in the cradle 74. In an embodiment, the apertures 76 are generally cylindrical. By "generally cylindrical" the apertures 76 may include non-cylindrical elements, e.g., ridges, protrusions, or recesses, and/or may include regions along its length that are not cylindrical, such as tapered and/or flared ends due to manufacturing and design considerations. Furthermore, the cradle can be open at least at one end and define a hollow interior portion. Additionally or alternatively, a bearing surface 77 may surround one or more of the apertures 76 such that the bearing surface 77 extends into the hollow interior portion. For example, bearing surfaces 77 may surround each of the apertures 76. One or more walls 78 may have a portion thereof that extends into the hollow interior portion. In an embodiment, a pair of walls 78 may each have a portion that extends into the hollow interior portion. Optionally, the pair of walls 78 may be offset such that they are not in opposing alignment. For example, the walls 78 can be generally parallel and generally non-coplanar. Furthermore, the pair of walls 78 may be arranged so that they do not overlap. Top surfaces 79 of the walls 78 may have a lead-in surface, such as a sloped top surface or a rounded edge top surface to lead a distal end of a cantilever tail of a pod into and between the walls 78 during assembly. Additionally or alternatively, the hollow interior portion may also include at least one shelf 80 or at least one sloped surface that at least partially extends into the hollow interior portion.

In one embodiment, the cradle 74 forms a closed, integral loop to provide structural strength and integrity. Alternatively, the cradle does not form a closed loop, but is still integrally formed. Where the cradle does not form a closed loop, the cradle can be made thicker for added strength and integrity. In forming an integral structure, the cradle 74 does not require separate components for assembly; separate components may come apart upon drop impact. An integral structure facilitates easier manufacturing, e.g., via use of a single material, and when the cradle 74 is, optionally, substantially rigid or immobile, the rigidity helps to prevent the apertures 76 from spreading apart upon drop impact and thus helps to prevent release of an engaged pod. Thus, the cradle 74 can be durable and made from non-deforming material, e.g., metal diecast, such as zinc diecast, or substantially rigid or immobile plastic. The rigidity of the cradle 74 also facilitates more reliable control of the distance of the apertures 76 as well as their concentric alignment. In an embodiment, the cradle 74 is integrally formed with the walls 78 to form one component. Additionally or alternatively, the entire frame 72 of the handle can be substantially rigid or immobile in which soft or elastic components may be optionally disposed on the frame 72 to assist with a user gripping the razor.

FIGS. 10A through 10E depict a procedure for assembling a handle of the present invention. A frame 82 of the handle comprises a cradle 84 defining an opening at least at one end and a hollow interior portion therein. Each of a pair of offset walls 86 of the frame 82 has a portion thereof that extends into the hollow interior portion. A flexible pod 90 comprises a base 92 and a flexible cantilever tail extending from the base 92. The cantilever tail comprises an elongate stem 94 and a perpendicular bar 96 at a distal end thereof. To engage the frame 82 and the pod 90, the pod 90 is positioned (Step 1) within the hollow interior portion of the frame 82 and aligned such that a first mounting member 98 of the pod 90 correspond in shape and align with a second mounting member 100 of the frame 82 and the perpendicular bar 96 of the cantilever tail is located near the walls 86 of the frame 82. In an embodiment, the first mounting member 98 of the pod 90 comprise one or more projections extending from the base 92 and the second mounting member 100 of the frame 82 comprise one or more apertures formed in the cradle 84. To assist in preventing improper alignment and engagement of the pod 90 and the cradle 84, in embodiments with a plurality of projections extending from the base 92 and a plurality of apertures formed in the cradle 84, one of the projections is larger than the other projections and one of the corresponding apertures is larger than the other apertures. Additionally or alternatively, the first mounting member 98 of the pod 90 comprise one or more apertures formed in the base 92 and the second mounting member 100 of the frame 82 comprises one or more projections extending into the hollow interior portion of the cradle 84. The base 92 and/or the first mounting member 98 of the pod 90 are then compressed and positioned (Step 2) such that the first mounting member 98 aligns with the second mounting member 100 and the perpendicular bar 96 is located between the walls 86. When decompressed, the first mounting member 98 mates with the second mounting member 100 and the perpendicular bar 96 is loosely retained by the walls 86. In an embodiment, of the cantilever tail, only the distal end of the cantilever tail, specifically the perpendicular bar 96, contacts the frame 82 when the pod 90 is decompressed. For example, substantially all of the elongate stem 94 of the cantilever tail does not contact the frame 82. In an embodiment in which the pod 90 comprises bearing pads and the cradle 84 comprises bearing surfaces, when the pod 90 is coupled to the cradle 84, the bearing pads of the pod 90 are configured such that substantially the remaining portions of the base 92 (e.g., other than the bearing pads and the first mounting member 98) do not contact the cradle 84. Having only the bearing pads and the first mounting member 98 contact the cradle 84 serves to reduce or minimize the friction and/or resistance of the pod 90 when rotated relative to the cradle 84. A portion of a docking station 102 is then positioned (Step 3) within a hollow interior portion of the pod 90 and then mated (Step 4) to the pod 90 such that extensions of the docking station 102 correspond in shape and mate with grooves and/or detents on an interior surface of the pod 90. In an embodiment, the docking station 102 is substantially rigid such that the pod 90 is locked into engagement with the frame 82 when the docking station 102 is coupled to the pod 90. Additionally or alternatively, the docking station 102 is stationary relative to the pod 90. For example, wires can stake the docking station 102 to the pod 90. In an embodiment, when the docking station 102 is staked to the pod 90, the docking station 102 can expand the pod 90, for example, the distance between the projections, beyond the pod's 90 as-molded dimensions. An ejector button assembly 104 corresponds in shape and mates (Step 5) with the pod 90 by aligning and engaging extensions of the ejector button assembly 104 with corresponding grooves and/or detents on the interior surface of the pod 90. In an embodiment, once the ejector button assembly 104 is engaged to the pod 90, the ejector button assembly 104 is movable relative to the pod 90+and the docking station 102 such that movement of the ejector button assembly 104 ejects a blade cartridge unit attached to the docking station. In an alternative embodiment, the ejector button assembly 104 can be engaged to the pod 90 before the docking station 102 is engaged to the pod 90.

Figure 11:
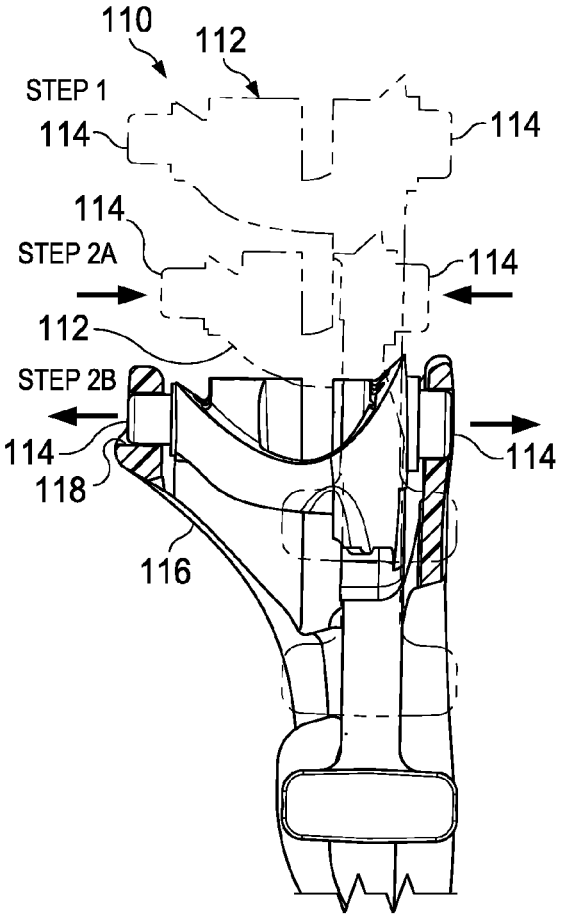
FIG. 11 depicts a procedure for compressing a pod in accordance with an embodiment of the invention.

FIG. 11 depicts a procedure for compressing and decompressing a flexible pod 110, which comprises a base 112 and one or more projections 114 extending from the base 112. In an embodiment, the entire pod 110 is flexible and, therefore, compressible such that the pod 110 is engageable with a frame 116 (shown in sectional view in FIG. 11) defining one or more apertures 118 and a hollow interior portion. To engage the pod 110 to the frame 116, similar as to discussed above, the pod 110 is positioned (Step 1) within the hollow interior portion of the frame 116. The base 112 and/or the projections 114 of the pod 110 are then compressed (Step 2A) such that the projections 114 freely clear the hollow interior portion of the frame 116 and the projections 114 can then align with the apertures 118. By compressing the base 112 along the portions with the projections 114, the base 112 and the projections 114 of the pod 110 fit substantially entirely within the hollow interior of the frame 116. When decompressed (Step 2B), the pod 110 is free to spring back to its open, natural position and the projections 114 mate with the apertures 118. In an embodiment, when decompressed, the projections 114 penetrate deep into the apertures 118 for a secure fit into the frame 116, which can be substantially rigid or immobile. Additionally or alternatively, the projections 114 correspond in size and mate with the apertures 118 via a pin arrangement, ball and socket arrangement, snap-fit connection, and friction-fit connection.

A distal end of the projections 114 can be disposed about or near an exterior surface of the frame 116. In such an arrangement, robustness of the entire razor assembly need not be compromised so that features can jump each other in assembly. Additionally, separate features or components are unnecessary to achieve deep penetration into the apertures 118. For example, the apertures 118 are not defined by more than one component and the apertures 118 do not need to be partially open on the top or bottom to engage the projections 114 into the apertures 118. Because the frame 116 is formed from substantially rigid or immobile material, the projections 114 and the apertures 118 can be designed to engage without requiring any secondary activity, such as dimensional tuning, to ensure proper positioning while also minimizing the slop of the pod 110 when rotating relative to the frame 116. In an embodiment, the frame 116 is integrally formed with the walls, such as a pair of offset walls, to form one substantially rigid or immobile component. In such an arrangement, the rest position of the pod 110 is more precisely controlled. Additionally or alternatively, the frame 116 is at least partially formed from flexible material that can flex and/or stretch open to facilitate engagement of the projections 114 into the apertures 118.

Figure 12A:
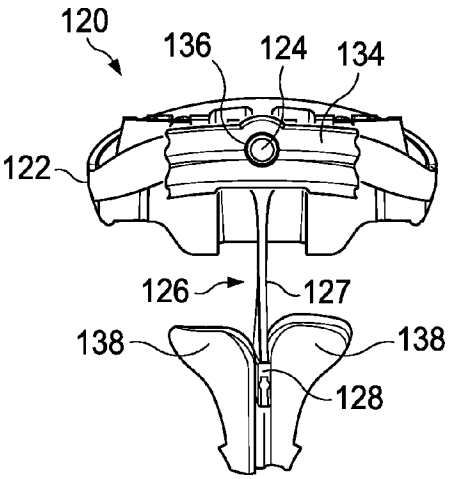
FIGS. 12A-12C depict a schematic front view of a pod and a portion of a frame of a handle during various stages of rotation according to an embodiment of the invention.
Figure 12B:
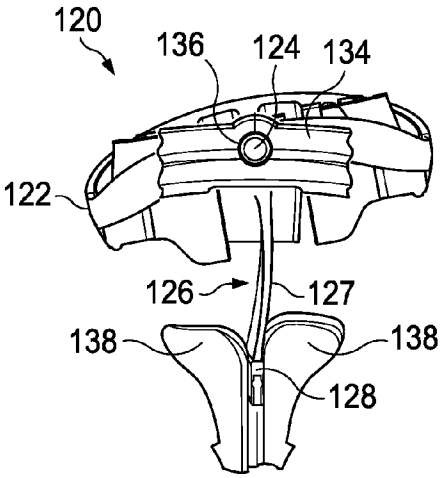
Figure 12C:
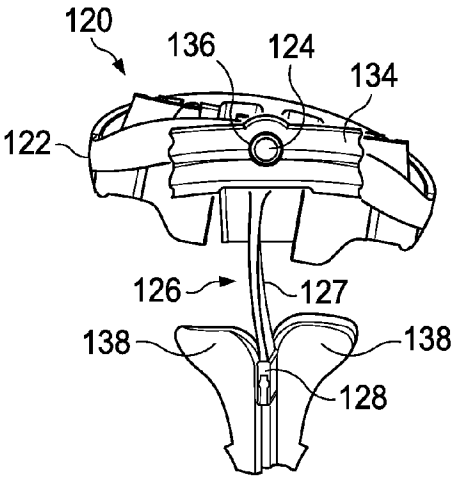

FIGS. 12A though 12C depict a portion of a handle during various stages of rotation. A flexible pod 120 comprises a base 122 with projections 124 and a cantilever tail 126 extending therefrom. The cantilever tail 126 comprises an elongate stem 127 and a perpendicular bar 128 at a distal end thereof. A frame 134 defines one or more apertures 136, and the frame 134 also comprises a pair of offset walls 138. FIG. 12A depicts a rest position of the pod 120 with respect to the frame 134 when no forces are being applied to the pod 120. In an embodiment, the cantilever tail 126 and/or the perpendicular bar 128 can have a spring preload when engaged with the frame 134, which minimizes or eliminates wobbliness of the pod 120 when the pod 120 is in the rest position. The spring preload provides stability to a blade cartridge unit upon contact with a shaving surface. In such an arrangement, the rest position of the pod 120 is a preloaded neutral position. Aligning the pod 120 in the preloaded neutral position relative to the frame 134 and establishing the spring preload are precisely controlled due to the pod 120 being a single component and the frame 134 and the walls 138 being formed from a single, unitary component. Further, by loosely retaining the perpendicular bar 128 of the cantilever tail 126 with a pair of offset walls 138, the requirement for clearance, for example, to account for manufacturing errors and tolerances, between the perpendicular bar 128 and the walls 138 is minimized or eliminated. The offset of the walls 138 allows the perpendicular bar 128 to spatially overlap the walls 138 without having the walls 138 grip or restrain the perpendicular bar 128, thereby avoiding the necessity of opposing retaining walls. Opposing retaining walls require clearance between the walls and the perpendicular bar to allow for free movement of the perpendicular bar and for manufacturing clearances. Such a clearance would result in unrestrained or sloppy movement of the pod 120 at the preloaded neutral position as well as perhaps a zero preload. Alternatively, opposing retaining walls without clearance would pinch the perpendicular bar and restrict motion.

When forces are applied to the pod 120, for example, via the blade cartridge unit when coupled to the pod 120, the pod 120 can rotate relative to the frame 134. The projections 124 of the pod 120 are sized such that the projections 124 rotate within the apertures 136 to facilitate rotation of the pod 120. In such an arrangement, when the pod 120 is engaged to the frame 134, the projections 124 can only rotate about an axis, but not translate. In an embodiment, the projections 124 have a fixed axis, (i.e., the concentric alignment of the apertures 136) that it can rotate about. Additionally or alternatively, the projections 124 can be sized so that frictional interference within the apertures 136 provides certain desirable movement or properties. When the pod 120 is rotated, because the perpendicular bar 128 of the pod 120 is loosely retained by the pair of offset walls 138, the offset walls 138 interfere with and twist the perpendicular bar 128 of the pod 120 such that the elongate stem 127 flexes. Optionally, substantially all of the cantilever tail 126, including the elongate stem 127 and the perpendicular bar 128 flexes or moves during rotation. Alternatively, upon rotation, only a portion of the cantilever tail 126, specifically the elongate stem 127, flexes or moves. In flexing, the cantilever tail 126 generates a return torque to return the pod 120 to the rest position. In an embodiment, the elongate stem 127 generates the return torque upon rotation of the pod 120. The larger the rotation of the pod 120, the larger the return torque is generated. The range of rotation from the preloaded neutral position can be about +/−4 degrees to about +/−24 degrees, preferably about +/−8 degrees to about +/−16 degrees, and even more preferably about +/−12 degrees. The frame 134 of the handle can be configured to limit the range of rotation of the pod 120. In an embodiment, shelves or sloping surfaces that extend into the interior of the frame 134 can limit the range of rotation of the pod 120 in that an end of the pod 120 will contact the respective shelf or sloping surface. The return torque can be either linear or non-linear acting to return the pod 120 to the rest position. In an embodiment, when rotated to +/−12 degrees from the rest position, the return torque can be about 12 N*mm.

Referring back to FIGS. 5 through 9, a pod 60 of the present invention can be molded from one material, such as Delrin® 500T. To achieve a return torque of the cantilever tail 65 of 12 N*mm when the pod 60 has been rotated +/−12 degrees from an at rest position (e.g., a preloaded neutral position), a length L1 of the elongate stem 67 is about 13.4 mm. A thickness T of the elongate stem 67, measured around its thickest point at about a mid-point along the length L1 of the elongate stem 67, is about 0.62 mm. A height H of the elongate stem 67 is about 2.8 mm.

The perpendicular bar 68 of the cantilever tail 65 has a thickness t, measured around its widest point, of about 1.2 mm. In this embodiment, the thickness t of the perpendicular bar 68 is generally thicker than the thickness T of the elongate stem 67, though various embodiments of the perpendicular bar 68 can have greater or lesser thickness compared to the thickness of the elongate stem 67. The thickness t of the perpendicular bar 68 affects the preload of the cantilever tail 65, but the thickness t of the perpendicular bar 68 may not generally affect the bending of the elongate stem 67 and, thus, may not affect the return torque when the pod 60 is rotated from the rest position. In an embodiment, a height h of the perpendicular bar 68 is greater than the height H of the elongate stem 67. For example, the height H of the perpendicular bar 68 can be in the range of about 0.2 times to about 5 times the height h of the elongate stem 67, preferably about 2.2 times the height H of the elongate stem 67 (e.g., about 6.2 mm). A length L2 of the perpendicular bar 68 is about 3.2 mm. In one embodiment, the thickness of the elongate stem 67 can be about 0.1 mm to about 2.5 mm, preferably about 0.4 to about 1.0 mm, even more preferably about 0.7 mm. The length of the elongate stem 67 can be about 3 mm to about 25 mm, preferably about 11 mm to about 15 mm, and even more preferably about 13 mm, such as 13.5 mm. The height of the elongate stem 67 can be about 0.5 mm to about 8 mm, preferably about 2 mm to about 4 mm, and even more preferably about 3 mm, such as 2.8 mm When the pod 60 is coupled to the frame 72 of a handle and the perpendicular bar 68 is loosely retained by the pair of offset walls 78, a distance between the center of the height h of the perpendicular bar 68 to the point of contact with an offset wall 78 can be in a range of about 0.4 mm to about 5 mm, preferably about 2.1 mm such that generally a distance between the offset walls 78 is about 4.2 mm. In an embodiment, the dimensions between the walls 78 can vary with the dimensions of the cantilever tail 65. When the pod 60 is coupled to the frame 72 of the handle, the twist of the perpendicular bar 68 is about 9.4 degrees such that one of the offset walls 78 laterally displaces the point of contact of the perpendicular bar 68 in a range of about 0.1 mm to about 1.0 mm, preferably about 0.33 mm. The aperture 76 on the front of the frame 72 is preferably about 3.35 mm in diameter and an aperture 76 on the rear of the frame 72 is preferably about 2.41 mm in diameter. In an embodiment, any of the apertures 76 of the frame 72 can have a diameter sized in the range of about 0.5 mm to about 10 mm. The corresponding projections 64 of the base 62 of the pod 60 are preferably about 3.32 mm and about 2.38 mm in diameter, respectively. In an embodiment, any of the projections 64 of the base 62 can have a diameter sized in the range of about 0.5 mm to about 11 mm. Due to molding of the pod 60, proximal portions of the projections 64 of the pod 60 can be tapered. Additionally or alternatively, the corresponding apertures 76 of the frame 72 can be tapered or not tapered: A distance between bearing surfaces 77 within an interior of the frame 72 is preferably about 12.45 mm. In an embodiment, a distance between bearing surfaces 77 can be in the range of about 5 mm to about 20 mm. When the pod 60 is coupled to the frame 72 and a docking station (not shown) is coupled to the pod 60, a distance between the bearing pads 66 of the pod 60 can be in the range of about 5 mm to about 20 mm, preferably about 12.3 mm.

In an embodiment, to achieve similar stiffness and/or return torques of the elongate stem 67 using other materials, the thickness of the elongate stem 67 can be varied. For example, forming the pod 60 from Hostaform® XT 20, the thickness T1 of the elongate stem 67 can be increased about 13% to about 23%, preferably about 15% to about 21%, and even more preferably about 18%. Forming the pod 60 from Delrin® 100ST, the thickness T1 of the elongate stem 67 can be increased about 14% to about 24%, preferably about 16% to about 22%, and even more preferably about 19%.

Various return torques can be achieved through combinations of material choice for a pod and dimensions of a cantilever tail. In various embodiments, to achieve a desired return torque, the material and/or shape of the pod can be selected from a range of a highly flexible material with a thick and/or short cantilever tail to a substantially rigid material with a thin and/or long cantilever tail. A range of desired return torque can be about slightly higher than 0 N*mm to about 24 N*mm, preferably about 8 N*mm to about 16 N*mm, and even more preferably about 12 N*mm, at about 12 degrees of rotation. Preferably, the pod is formed from thermoplastic polymers. For example, nonlimiting examples of materials for the pod with desirable properties, such as flexibility, durability (breakdown from drop impact), fatigue resistance (breakdown from bending over repeated use), and creep resistance (relaxing of the material), can include Polylac® 757 (available from Chi Mei Corporation, Tainan, Taiwan), Hytrel® 5526 and 8283 (available from E. I. duPont de Nemours & Co., Wilmington, Del.), Zytel® 122L (available from E. I. duPont de Nemours & Co., Wilmington, Del.), Celcon® M90 (available from Ticona LLC, Florence, Ky.), Pebax® 7233 (available from Arkema Inc., Philadelphia, Pa.), Crastin® S500, S600F20, S600F40, and S600LF (available from E. I. duPont de Nemours & Co., Wilmington, Del.), Celenex® 1400A (M90 (available from Ticona LLC, Florence, Ky.), Delrin® 100ST and 500T (available from E. I. duPont de Nemours & Co., Wilmington, Del.), Hostaform® XT 20 (available from Ticona LLC, Florence, Ky.), and Surlyn® 8150 (available from E. I. duPont de Nemours & Co., Wilmington, Del.). Furthermore, the selection of a material may affect the stiffness and yield stress of the pod or an elongate stem of the cantilever tail. For example, each material may have different stiffnesses depending on the temperature and rate of rotation of the pod relative to the frame. Dimensions of the cantilever tail can be varied to achieve a desired torque and/or a desired stiffness. For example, the cantilever tail can be thicker and/or shorter (for increased stiffness), as well as thinner and/or longer (for decreased stiffness). In an embodiment, the thickness of the cantilever tail, about its widest point, can be about 0.1 mm to about 3.5 mm, preferably about 0.4 to about 1.8 mm, even more preferably about 0.7 mm. The length of the cantilever tail can be about 3 mm to about 25 mm, preferably about 11 mm to about 19 mm, and even more preferably about 13 mm, such as about 13.5 mm. The height of the cantilever tail can be about 0.5 mm to about 18 mm, preferably about 2 mm to about 8 mm, and even more preferably about 3 mm, such as about 2.7 mm. In one embodiment, the pod and tail can be made from the same composition or combination of materials. In another embodiment, the pod and tail can have different compositions.

In one embodiment, the cantilever tail comprises PEEK, which is an acronym for PolyEtherEtherKetone, such as Victrek® PEEK plastic. PEEK is a linear aromatic polymer which is semi-crystalline and is widely regarded as the highest performance thermoplastic material. Without intending to be bound by theory, it is believed that PEEK does not stress relax and has a constant modulus of elasticity through a wide range of temperatures.

PEEK has repeating monomers of two ether and ketone groups, as shown in the following formula:

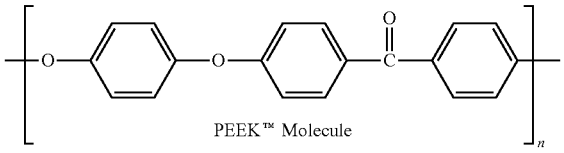

PEEK™ Molecule

Figure 13:
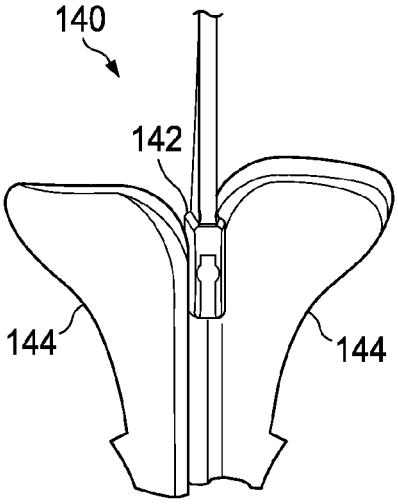
FIG. 13 is a schematic perspective view of a portion of a cantilever tail of a pod and a portion of a frame of a handle in accordance with an embodiment of the invention.

FIG. 13 depicts a portion of a cantilever tail 140 when a pod is in a rest position (e.g., a preloaded neutral position). In an embodiment, a thickness of a perpendicular bar 142 and/or the spacing of a pair of offset walls 144 can be configured such that the perpendicular bar 142 or the entire cantilever tail 140 is twisted, thus forming a spring preload for the cantilever tail 140, when the pod is in the rest position. For example, the angle of twist of the perpendicular bar 142 when the pod is in the preloaded neutral position can be in the range of about 2 degrees to about 25 degrees, preferably about 8 degrees to about 10 degrees, and even more preferably about 9.4 degrees. Additionally or alternatively, the offset walls 144 loosely retain the perpendicular bar 142 without gripping or restraining motion of the perpendicular bar 142 when the perpendicular bar 142 is twisted in the rest position.

Performance of Rotating System

Without intending to be bound by theory, it is now believed that the combination of a retention system (e.g., the cantilever tail) and surrounding structures creates a resisting torque upon rotation of a rotatable portion (e.g., a pod, a hood, and/or a cartridge) relative to a fixed portion (e.g., a handle). When looking at the performance of a rotating system and the resisting torque, one of skill in the art would understand that reference to a rotatable portion, such as the pod, relative to a fixed portion, would include any component attached to the rotatable portion that also rotates relative to the fixed portion. For example, reference to a pod may, optionally include a hood and/or a cartridge. In one embodiment, the retention system comprises the combination of the frame, pod, and cantilever tail. Those of skill in the art will understand that various types of retention systems can be used with a handle for use with a shaving razor. Depending on the types of movement desired, the retention system can be used to accommodate rotational type movement about different rotational axes depending on how the cartridge is attached to the handle.

In one embodiment, the torque results in a desired and useful dynamic motion of the pod relative to the handle in response to the shape of the shaver's face and the motion of the shaving stroke. This torque response dictates the dynamic behavior of the pod such as the speed and amount the deflection of the pod from its initial position in response to changes in facial contour or handle position.

Without intending to be bound by theory, it is believed that this torque response can be impacted by multiple factors, including but not limited to the stiffness of the cantilever tail, the damping/frictional effects on the pod's rotation, the distribution of mass in the pod and cartridge (inertia), and the shortest distance from the axis of rotation of the pod to the pivot axis of the cartridge or, for a fixed pivot cartridge, the point of resultant equivalent torque-force system at the center of mass of the cartridge. It is believed that this dynamic response may be described by differential equations that are slightly non-linear and that have coefficients of the differential equations that depend on relative angular position and rotational speed between the pod and the grip portions of the handle and on environmental conditions such as shaving speed, axle load, or temperature.

Although the actual differential equations are non-linear and have varying coefficients, various aspects of the dynamic response related to shaving can be understood using a simplified equation showed in Equation A that has linear differential equations with constant coefficients for stiffness, damping, and inertia.

(Equation A)

$$\frac{d}{dt}\begin{pmatrix} \frac{d\theta_p}{dt} \\ \theta_p \end{pmatrix} = \begin{bmatrix} \frac{-C}{I} & \frac{-K}{I} \\ 1 & 0 \end{bmatrix}\begin{pmatrix} \frac{d\theta_p}{dt} \\ \theta_p \end{pmatrix} + \begin{bmatrix} \frac{K}{I} & \frac{C}{I} & \frac{1}{I} & \frac{L}{I} \\ 0 & 0 & 0 & 0 \end{bmatrix}\begin{pmatrix} \theta_h \\ \frac{d\theta_h}{dt} \\ T_c \\ F_c \end{pmatrix}$$

where

θp=pod rotation;

θh=handle rotation;

I=Total inertia of moving parts (e.g., pod and cartridge);

C=damping coefficient;

K=pod stiffness;

$T_c$=Resultant torque on cartridge from face;

$F_c$=Resultant force on cartridge from face; and

L=distance from the axis of rotation to the point of resultant equivalent torque-force system of the cartridge.

For purposes of illustration, L is shown in FIG. 14.

FIG. 14 provides a simplified diagram of a handle 193 for a shaving razor, showing the various elements used in the formula of Equation A. The handle 193 has a retention system 194 for a portion that rotates. A cartridge 195 can be attached to the handle 193, e.g., to the retention system 194. Those of skill in the art will understand that the formula for Equation A is derived from basic fundamentals of system dynamics. See, e.g., Kasuhiko Ogata, *System Dynamics* ($4^{th}$ ed, Pearson 2003); Jer-Nan Juang, *Applied System Identification* (Prentice Hall, 1994); Rolf Isermann and Marco Munchhof, *Identification of Dynamic Systems: An Introduction with Applications* ($1^{st}$ ed. 2011). Equation A can be used to calculate the desired torque response of a pod. The ranges of the values in Equation A are those that can be determined using standard methods of system dynamics and/or system identification. Simplified equations to determine certain values are described in the Test Methods section. Further, commercial software packages to carry out these techniques are available from The Mathworks, Inc. and National Instruments.

Without intending to be bound by theory, it is believed that the values of each of the parameters of the rotating system—stiffness, damping, inertia, and the shortest distance from the axis of rotation of the pod to the pivot axis of the cartridge or, for a fixed pivot cartridge, the point of resultant equivalent torque-force system at the center of mass of the cartridge—are important to the torque response of the handle. This response allows the razor cartridge to contour the skin surface in a desirable manner. Without intending to be bound by theory, it is believed that various portions and contours of skin can be shaved using this type of device, including but not limited to the face, the neck, the jaw, underarms, torso, back, pubic area, legs and so forth.

It is believed that stiffness provides the restoring torques to counter deviations from the pod's initial position relative to the handle. The stiffness value is the proportionality constant between the torque required to hold the pod at a constant angular deflection position from its initial position relative to the handle. During actual shaving motions, high values of stiffness make it more difficult for the pod to undertake large deflections from its initial position while low values of stiffness make it easier for the pod to be deflected from its initial position.

It is further believed that the damping value is the proportionality constant that relates the component of the torque resisting the speed of motion between the pod and the handle. Damping is especially important because its presence at certain levels prevents the pod from feeling too loose to the shaver during shaving at small angle deviations from the pod's initial position, while high levels of damping will resist rotation too much. At these small angle deviations, the resisting torques from damping constitute significant portion of the dynamic response because the torques from the stiffness component are small.

It is further believed that the inertia value is the proportionality constant that relates the component of the torque resisting the acceleration of motion between the pod and the handle. Higher values of inertia make the dynamic response of the handle more sluggish.

The cartridge moment arm, the distance from the axis of rotation to the pivot point of the cartridge or the center of the cartridge for fixed pivot cartridges, is also an important value. For a given set of values for stiffness, damping, and inertia, the cartridge moment arm has been shown to be important to the feel of the razor during shaving as it is related to the forces transmitted to the face from the razor.

Using Equation A to determine the values of a handle's parameters from data collected while shaving may be challenging. For this reason, two simple methods are outlined below which allow a person skilled in the art of system dynamics and system identification to determine the values of stiffness and damping The first method is the Static Stiffness Method, and it can be used to determine the value of stiffness for the handle. The second method is the Pendulum Test Method, and it can be used to determine the values of damping for a given test condition. Determination of inertia about an axis of rotation is a simple calculation by equations found in introductory textbooks in solid mechanics. Many computer aided design packages (CAD) such as Solidworks or ProEngineer automatically calculate the inertia of a component around a given axis. The cartridge moment arm is calculated by direct measurement.

Test Methods (1) Static Stiffness Method

Without intending to be bound any theory, it is believed that the static stiffness of a shaving razor described herein can be determined using a static stiffness method in which torques are measured relative to angles of displacement of the pod from its rest position.

Static stiffness is understood to be the measurement of proportionality constant between torque and the angle when the relative angle between the pod and the handle is held constant.

(a) Definitions and Environment Conditions for Static Stiffness Value:

In a simplified example shown in FIG. 15A, the various parts of a shaving razor that help to understand the static stiffness value include the components that are fixed and the components that rotate relative to the fixed components. For example, the components that are fixed include a handle 200 that is held by the user. In an embodiment, the handle 200 may have a length of that is generally along a longitudinal axis 202. The components that rotate relative to the fixed components include a pod 204 that rotates relative to the handle 200. In an embodiment, the pod 204 may allow for the attachment of a razor cartridge, which may or may not rotate relative to the pod.

The angles of displacement measured in accordance with the Static Stiffness Method are the angles of deflection of the components that rotate relative to the at rest position of said components. In the embodiment shown in FIG. 15A, the angle 206 is defined as the relative angle of pod 204 from the at rest position of the pod 204. In this embodiment, the zero angle position of the pod 204 is defined to be the rest position of the pod 204 relative to the handle 200 when (1) the handle 200 is fixed in space, (2) the pod 204 is free to rotate about its pivot axis relative to the fixed handle 200, (3) the pivot axis of the pod 204 is oriented vertically (perpendicular to the ground and parallel to the gravity vector), and (4) no external forces or torques other than those transmitted from the handle 200 and gravity act on the pod 204. Prior to measurement, all rotations of the pod to one side of the zero angle position are designated as positive, while the rotations of the connecting portion to the other side of the zero angle position are designated as negative.

Figure 15B:
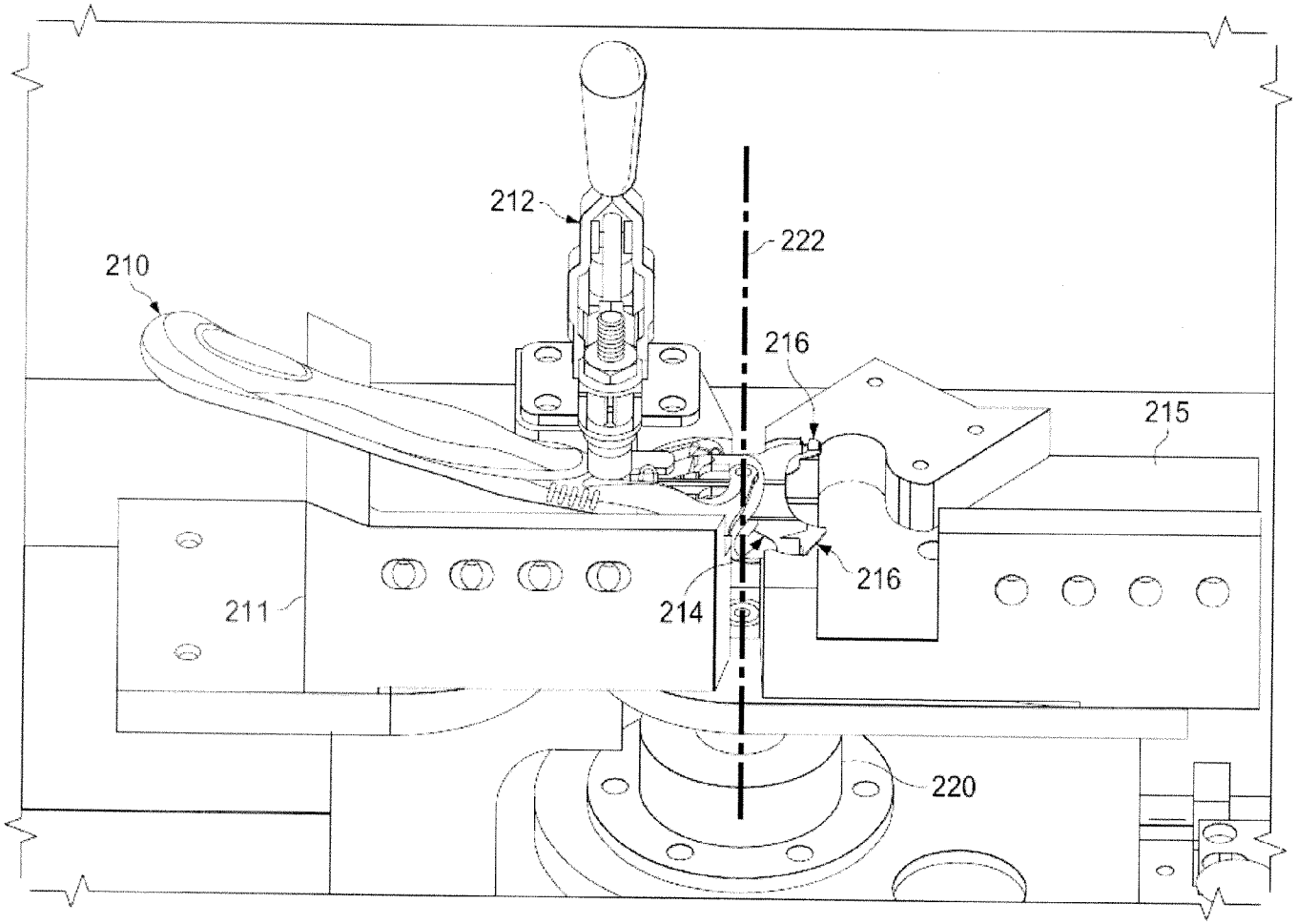

According to an embodiment of the invention, shown in FIG. 15B is an exemplary set-up to measure torque. A handle 210 is secured to a rotating stage 211 by a clamp 212. A pod 214 is secured to a fixed stage 215 by additional clamps 216. In an embodiment, other components may, optionally, be attached to the pod 214 such as a hood and/or a cartridge. To measure torque, a torque sensor 220 is used and attached to the fixed stage 215 in which the axis of the torque sensor 220 is collinear with the axis about which the pod rotates 222. The torque sensor 220 has an accuracy of at least +/−0.3% and a zero balance of +/−2%, and a full scale output of +/−200 N*mm. One example of a torque sensor is the TQ202-30Z (available from Omega Engineering, Stamford, Conn.). The component of torque that is being measured is about the pivot axis between the handle 210 and the pod 214. For example, if the pivot axis is coincident to the z-axis of a coordinate system, the torque that is being measured is in the z direction. The sign convention of the torque measurement is positive for positive rotations of the pod 214 relative to the handle 210 and negative for negative rotations of the pod 214 relative to the handle 210.

The environmental test conditions for calculating static stiffness are as follows. Measurements are performed at room temperature, i.e., 23 degrees Celsius. The shaving razor is submerged in de-ionized water, also at room temperature, i.e., at 23 degrees Celsius, for between 30 seconds to 40 seconds prior to running the static stiffness method, so that the pod is lubricated (i.e., wet). The static stiffness method is made and completed while the shaving razor is still wet within five minutes of removing the shaving razor from the de-ionized water.

(b) Measurement of the Torque-Angle Data

During measurements of the shaving razor, the pod of the shaving razor is fixed in space by a clamping mechanism that does not affect the rotation of the handle relative to the pod. During measurements, the razor is oriented as follows: (1) the pod is clamped, (2) the handle is free to rotate about the pivot axis between the handle and the clamped pod, and (3) the pivot axis between the handle and the pod is oriented vertically (perpendicular to the ground and parallel to the gravity vector).

The following is the sequence for measurement of the torque-angle data of a shaving razor. Remove the shaving razor from de-ionized water. While the shaving razor is still wet, clamp the shaving razor into the testing fixture in the zero angle position. Make the first measurement at the most negative value of the angle position being measured by moving the handle from the zero angle position to this most negative value angle position. Wait between 1 second to 5 seconds at this angle position. Record the torque value. Move to the next angle position at which a measurement is being made. Repeat the foregoing steps until all measurements are made, with the shaving razor still wet. In an embodiment, all steps need to be completed within 5 minutes of removal of the razor from de-ionized water.

The following angles are angles at which torque measurements are made for a shaving razor having a pod with a range of motion greater than or equal to about +/−5 degrees from the zero angle position. Torque will be measured for 21 angle measurements. The sequence of angle measurements in degrees is −5.0, −4.0, −3.0, −2.0, −1.0, 0.0, 1.0, 2.0, 3.0, 4.0, 5.0, 4.0, 3.0, 2.0, 1.0, 0.0, −1.0, −2.0, −3.0, −4.0, and −5.0.

The following angles are angles at which torque measurements are made for a shaving razor having a pod with a range of motion less than about +/−5 degrees from the zero angle position. Torque will be measured for 21 different angle measurements at equally spaced increments. The increments will be equal to range of motion divided by 10. For example, if a pod of shaving razor only has a range of motion from about −3 degrees to about +2 degrees, the increment is (2−(−3))/10=0.5 degrees; and the sequence of angle measurements in degrees is −3.0, −2.5, −2.0, 1.5, −1.0, −0.5, 0.0, 0.5, 1.0, 1.5, 2.0, 1.5, 1.0, 0.5, 0.0, −0.5, −1.0, −1.5, −2.0, −2.5, and −3.0.

FIG. 16 is a graph of torque vs. angle of rotation by degree for a sample device having a cantilever tail made of Hostaform® XT20 and designed in accordance with the embodiment shown in FIG. 1.

To determine the static stiffness value, plot the torque measurements (y-axis) versus the corresponding angle measurements (x-axis). Create the best fit straight line through the data using a least squares linear regression. The stiffness value is the slope of the line y=m*x+b, in which y=torque (in N*mm); x=angle (in degrees); m=stiffness value (in N*mm/degree); and b=torque (in N*mm) at zero angle from the best fit straight line.

In one embodiment the cantilever tail has a static stiffness of from about 0.7 N*mm/deg to about 2.25 Nmm/deg, preferably from about 0.9 N*mm/degree to about 1.9 N*mm/degree, and even more preferably about 1.1 N*mm/degree. In one embodiment, the static stiffness is from about 0.7 N*mm/ degree to about 1.8 N*mm/degree, preferably about 1.27 N*mm/degree, as measured by the Static Stiffness Method, defined herein. Those of skill in the art will understand that the stiffness of the cantilever tail is impacted by both the composition used to form the cantilever tail as well as the structural design of the cantilever tail (including aspects as thickness, length, and so forth). As such, depending on the specific type of retention member being used (in this case, the cantilever tail), using the same material can result in a different stiffness result depending on the design. Conversely, using a different material can still result in a stiffness within the present range, depending on the design.

Referring back to FIG. 1, the shortest distance between the axis of rotation 26 that is substantially perpendicular to the blades 32 and substantially perpendicular to the frame 22 and the axis of rotation 34 that is substantially parallel to the blades 32 and substantially perpendicular to the handle 20 can be in a range of about 10 mm to about 17 mm, preferably about 13 mm to about 15 mm. This distance can be understood as the cartridge moment arm. As this distance can be varied, understanding the stiffness of the retention system can be aided by calculating the stiffness to cartridge moment arm ratio. In an embodiment, the stiffness to moment arm ratio of can be in a range of about 0.05 N/degree to about 1.2 N/degree, preferably about 0.085 N/degree.

Figure 17A:
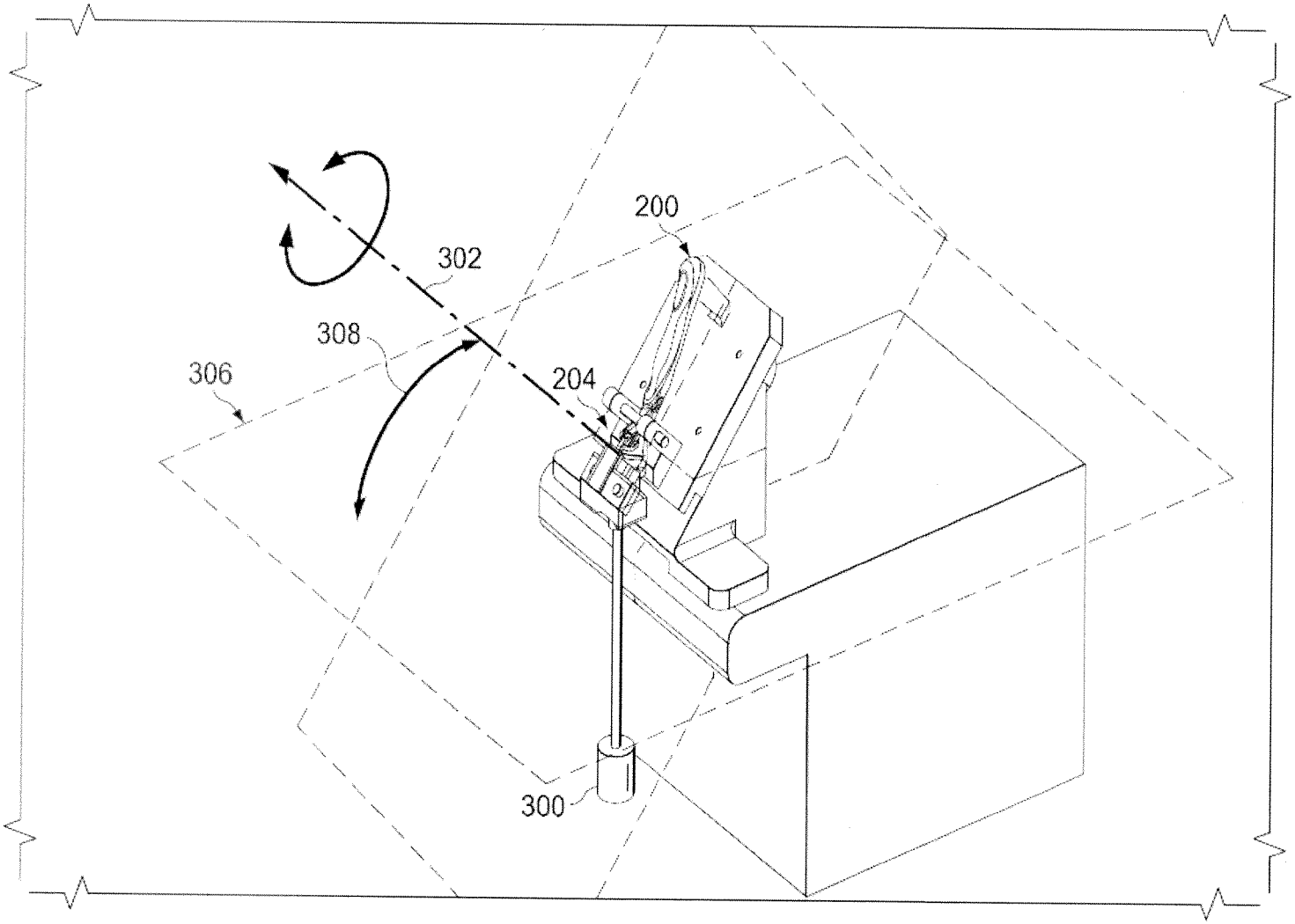
FIGS. 17A and 17B are sample perspective and side views, respectively, of a set up for conducting the Pendulum Test Method.

(2) Pendulum Test Method:

Because damping is the result of phenomena such as friction, it can only be measured when the pod is in motion relative to the handle or vice versa. One test to determine the damping coefficient from the observed motion uses a rigid pendulum that is attached to the pod in the same manner that a razor cartridge would be attached. The Pendulum Test Method is designed to measure the damping coefficient under loading conditions that are relevant to shaving. In an embodiment of the present invention, shown in FIGS. 17A and B are exemplary set ups of the pendulum test method.

(a) Definitions and Environment Conditions for Pendulum Damping Coefficient Value Test Method:

The various parts of a shaving razor that help to understand the damping coefficient value include components that can be fixed and components that rotate relative to the fixed components. Components that can be fixed include a handle 200 that is held by the user. Components that rotate relative to the fixed components include a pod 204. In an embodiment, the pod 204 may allow for the attachment of a razor cartridge, which may or may not rotate relative to the pod 204.

Handle 200 is fixed to a platform and pod 204 is attached to a pendulum 300. The pod 24 can rotate relative to the handle 200 about an axis of rotation 302. The handle 200 is fixed in space by a clamping mechanism that does not affect the rotation of the pod 204 and the pendulum 300 relative to the handle 200 in any manner. When the pendulum 300 is at rest, the pendulum 300 is parallel to the gravity vector. At rest, a plane 306 is perpendicular to the gravity vector, and the axis of rotation 302 of the pod 204 is measured 45 degrees separated from the plane 306. The combination of the weight of the pendulum and the 45 degree angle between the axis of rotation 302 and the plane 306 allows the damping coefficient to be measured under loading conditions that are relevant to shaving.

Figure 17B:
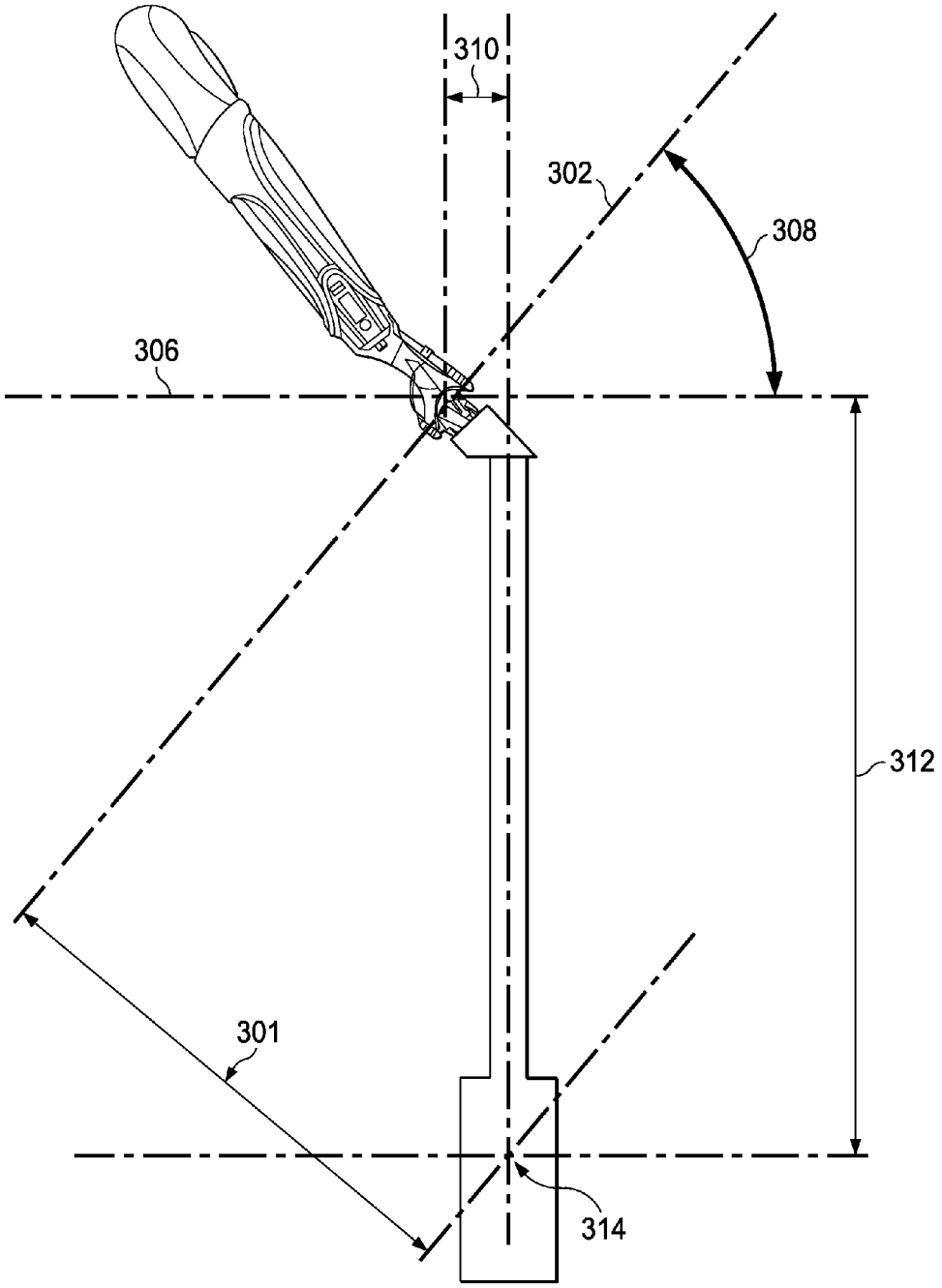
Figure 19A:
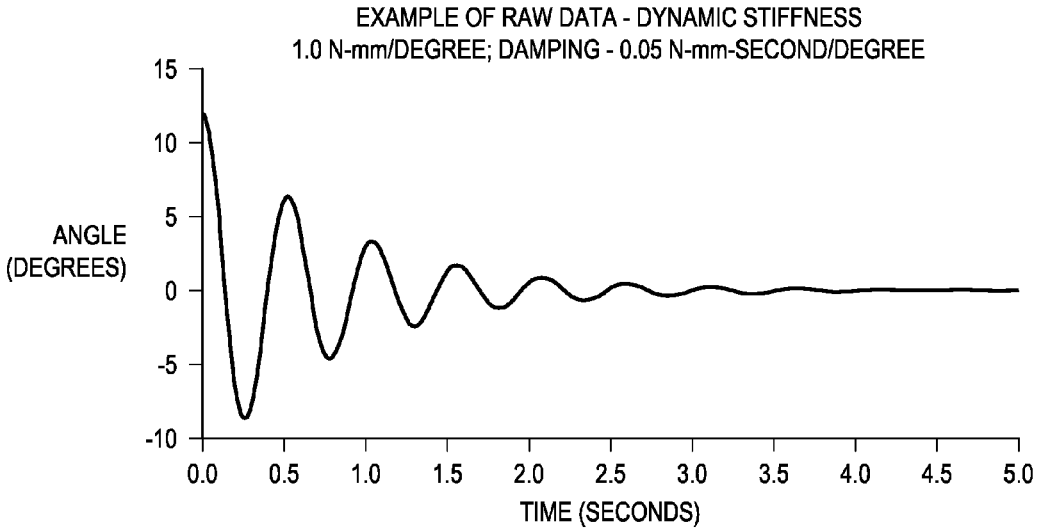
FIGS. 19A and 19B are graphs of data used to calculate a damping coefficient of a rotatable portion according to an embodiment of the present invention.
Figure 19B:
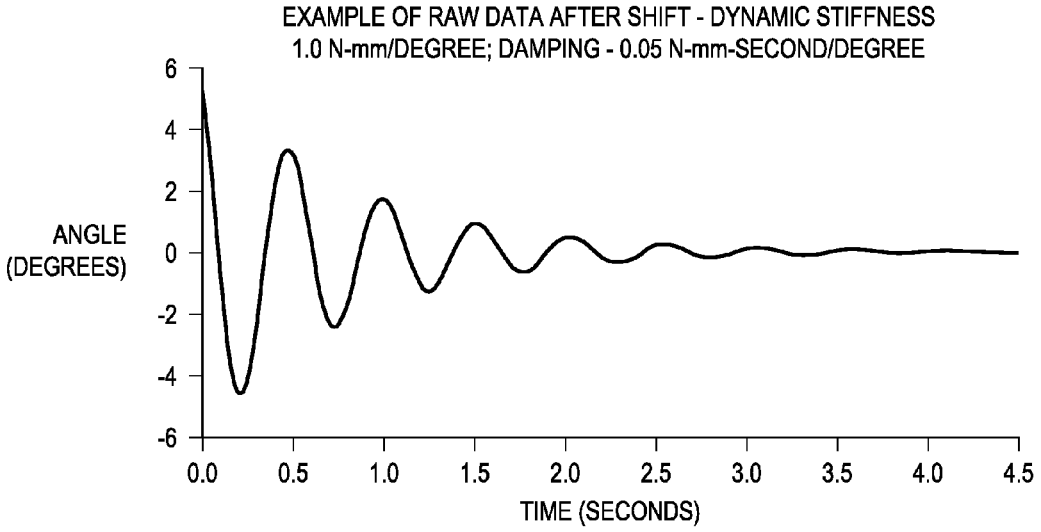
Figure 20A:
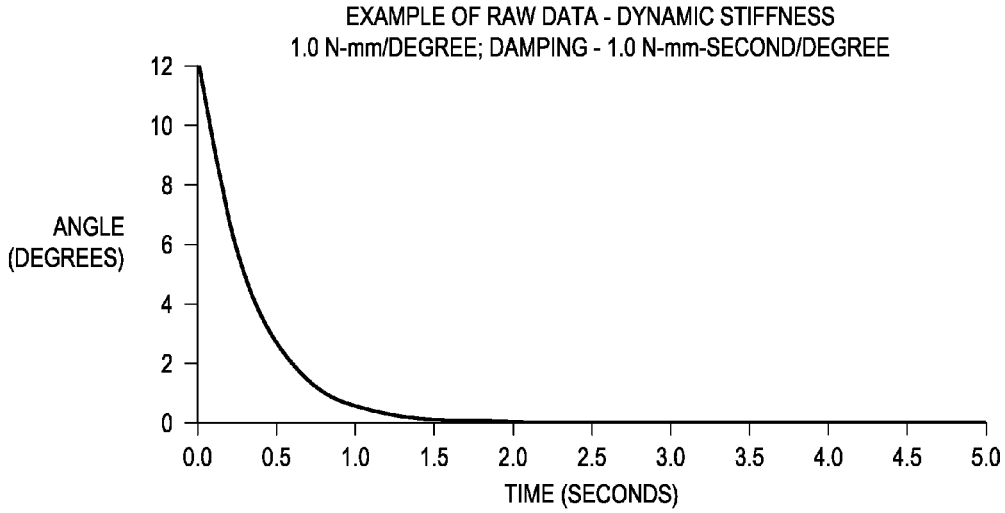
FIGS. 20A and 20B are graphs of data used to calculate a damping coefficient of a rotatable portion in accordance with an embodiment of the present invention.
Figure 20B:
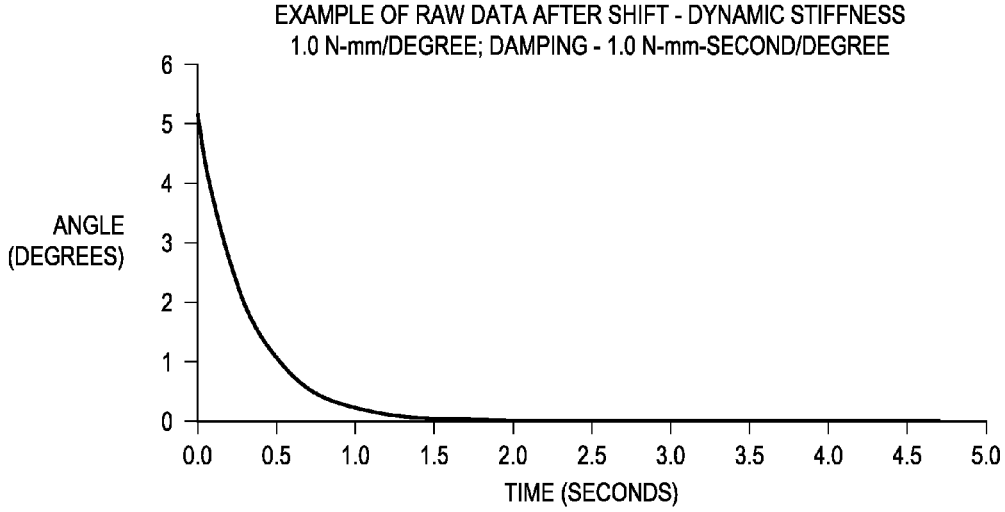

For the Pendulum Test Method, the measured angle is defined as the relative angle of the pod 204 from its at rest position as the pod 204 rotates about the pivot axis 302 between the pod 204 and the handle 200. The measured angle is not the deviation of the pendulum 300 from vertical. The zero angle position of the pod 204 relative to the handle 200 is defined to be the rest position of the pod 204 relative to the handle 200 when (1) the handle 200 is clamped such that its orientation in space is fixed, (2) the pod 204 (with attached pendulum 300) is free to rotate through its full range of motion about the pivot axis 302 between the fixed handle 200 and the rotating pod 204, (3) the angle 308 between the pivot axis 302 of the pod and the plane 306 perpendicular to the gravity vector is 45 degrees as shown in FIG. 17B, and (4) no forces or torques, such as additional friction, other than those transmitted from the handle and from gravity act on the pod or the pendulum (e.g., projections from the base of the pod, bearing pads of the pod, bearing surfaces of the cradle of the handle, etc.). Prior to measurement, all rotations of the pod 204 to one side of the zero angle position are designated as positive while the rotations of the pod 204 to the other side of the zero angle position are designated as negative.

The environmental test conditions for calculating the damping coefficient are as follows. Measurements are performed at room temperature, i.e., at 23 degrees Celsius. The hand held device, such as a shaving razor, is submerged in de-ionized water also at room temperature, i.e., at 23 degrees Celsius, for between 30 seconds to 40 seconds, so that the shaving razor is lubricated (i.e., wet). Measurements are made and completed while the shaving razor is still wet within five minutes of removing the shaving razor from the de-ionized water.

(b) Measurement of Angle During the Pendulum Test

The following is the sequence for measurement of the torque-angle data of a shaving razor. Remove the shaving razor from the de-ionized water. Clamp the shaving razor into the testing fixture in the zero angle position. The razor is clamped in such a way so that compliance of the non-rotating components does not affect measurement of the relative angle. Rotate the pod and the pendulum to the specified release point, discussed further below. Begin recording the angle data versus time at a sampling rate of at least 1000 Hz. Release the pendulum and record the angle data until the pendulum motion has stopped. The release of the pod/pendulum assembly must be accomplished from a stationary start—without imparting a rotational velocity to the assembly. This release must also not rub against the pod/pendulum assembly in any manner other than the forces and torques transmitted from the handle to the pod. The zero velocity/no rubbing pendulum release is to prevent the pendulum from being released while it is in motion or from affecting the acceleration of the pendulum after release. The sequence of measurements is to be completed within 2 minutes.

The release point of the pod/pendulum assembly is the smaller of the maximum deviation of the pod to either side of the zero angle position. For example, if the range of motion of a pod of a shaving razor is from about −5 degrees to about +4 degrees from the zero angle position, the release point would be +4 degrees. In another example, if the range of motion of pod of a shaving razor is from about −9 degrees to about +12 degrees from the zero angle position, the release point is about −9 degrees.

(c) Calculation of the Damping Coefficient for a Pod of a Shaving Razor having a Range of Motion Greater than or Equal to about +/−5 Degrees from the Zero Angle Position With reference to FIGS. 19A and 19B and 20A and 20B as examples, to calculate the damping coefficient, the time sequence of data is truncated to eliminate data which have an absolute value of angle greater than 5 degrees. The time axis is shifted so that the first data corresponds to a time equal to zero.

The following equations can be understood to calculate the damping coefficient.

$$\frac{d}{dt}\begin{pmatrix}\frac{d\theta}{dt}\\ \theta\end{pmatrix}=\begin{bmatrix}\frac{-C}{ML_p^2} & -\left(\frac{K_d}{ML_p^2}+\frac{g\cos\alpha}{L_p}\right)\\ 1 & 0\end{bmatrix}\begin{pmatrix}\frac{d\theta}{dt}\\ \theta\end{pmatrix} \quad \text{Equation B}$$

$$\ddot{\theta}+\frac{C}{ML_p^2}\dot{\theta}+\frac{(K_d+MgL_p\cos\alpha)}{ML_p^2}\theta=0 \quad \text{Equation C}$$

$$\xi=\frac{C}{2ML_p^2\omega_0} \text{ and } \omega_0=\sqrt{\frac{K_d}{ML_p^2}+\frac{g\cos\alpha}{L_p}} \quad \text{Equation D}$$

$$\xi=\frac{C}{2\sqrt{ML_p^2(MK_d+MgL_p\cos\alpha)}} \quad \text{Equation E}$$

$$\omega_d=\omega_0\sqrt{1-\xi^2} \quad \text{Equation F}$$

$$\theta(t)=e^{-\xi\omega_0 t}(A\cos(\omega_d t)\mid B\sin(\omega_d t)) \quad \text{Equation G}$$

$$\theta(t)=Ae^{-\gamma_2 t}+Be^{-\gamma_2 t} \quad \text{Equation H}$$

$$\theta(t)=(A+Bt)e^{-\omega_0 t} \quad \text{Equation I}$$

$$C=ML_p^2(\gamma_1+\gamma_2) \text{ and } K_d=ML_p^2\gamma_1\gamma_2-ML_pg\cos\alpha \quad \text{Equation J}$$

where

θ=angle of rotation of the pod from the at rest position

α=smallest angle between the axis of rotation and the horizontal plane, which is perpendicular to the gravity vector C=damping coefficient $K_d$=dynamic stiffness M=pendulum mass $L_p$=the shortest distance between the center of mass 314 of the pendulum and the rotational axis g=gravitational constant $\omega_0$=undamped natural frequency of the handle-pendulum-pod assembly $\omega_d$=damped natural frequency of the handle-pendulum-pod assembly A=coefficient based on angle initial condition at time=0

B=coefficient based on angle initial condition at time=0

ζ=Damping ratio.

With reference to FIG. 17, $L_p$ 301 can be determined according to the following equation: $L_p$=X sin α+Y cos α, in which X 310 is the shortest horizontal distance between the axis of rotation 302 of the pod and the center of mass 314 of the pendulum and Y 312 is the shortest vertical distance between the axis of rotation 302 of the pod and the center of mass 314 of the pendulum.

Using a least squares curves fit, the values of the damping coefficient and the dynamic stiffness are determined using the solutions for the classic $2^{nd}$ order spring-damper-mass differential equation. Equations B and C are different forms of the same differential equation, which has Equations G, H, and I as possible solutions.

For data that exhibits oscillatory angle versus time behavior, Equation G can be used as the form of the solution to the differential equation to curve fit the angle versus time data. In Equation G, coefficients A and B depend on the initial conditions at time (t) after the data has been truncated.

For data that does not exhibit oscillatory angle versus time behavior, two possible forms for the solution to the differential equation exist (Equations H and I). Using a least squares fit, determine which form of the differential equation solution best fits the data based on $R^2$ by optimizing A, B, $\omega_e$, $\gamma_1$ and $\gamma_2$ values. In Equations H and I, coefficients A and B depend on the initial conditions at time (t) after the data has been truncated. If Equation H is the best form of the solution to the differential equation, Equation J provides the dynamic stiffness ($K_d$) and the damping coefficient (C) using the solution to the characteristic equation of the $2^{nd}$ order differential equation given in Equation C. If Equation I is the best form of the solution to the differential equation, the dynamic stiffness ($K_d$) and the damping coefficient, C, can be solved from Equations D and E, where $$\xi=\frac{C}{2\sqrt{ML_p^2(MK_d+MgL_p\cos\alpha)}}=1.$$

(d) Calculation of the Damping Coefficient for Shaving Razors with a Pod having a Range of Motion Less than about +/−5 Degrees from the Zero Angle Position Without truncating the data, the damping coefficient for the shaving razors can be calculated using the steps outlined above with respect to Equation B through Equation J.

The dynamic stiffness value of the pendulum test is different from the static stiffness of the earlier test method because the dynamic stiffness is measured while the handle is moving relative to the pod. This motion may result in a different value of stiffness than the static stiffness test method because the elastic moduli of many spring materials (such as thermoplastics or elastomers) increase in value as the strain rate on the material increases. Springs made of these materials feel stiffer for the same amount of displacement when the springs are moved fast rather than slow. Generally, the dynamic stiffness of a razor having a rotatable portion in the handle is larger than that of its static stiffness, preferably about 20% larger, especially in light of the system having plastic components that flex since most plastic have elastic module that increase with strain rate.

In one embodiment, the damping is from about 0.01 N*mm*sec/degree to about 0.30 N*mm*sec/degree, or from about 0.2 N*mm*sec/degree to about 0.1 N*mm*sec/degree, or from about 0.09 N*mm*sec/degree to about 0.15 N*mm*sec/degree. In one embodiment, the damping is about 0.04 N*mm*sec/degree. In another embodiment, the damping can be comparatively lowered to 0.003 N*mm*sec/degree to about 0.03 N*mm*sec/degree. Without intending to be bound by theory, a lower damping value could be representative of a pod which will oscillate more times before it comes to rest compared to a higher damping value, when released from the same position with an otherwise similar retention system (i.e. similar cantilever tail).

Additionally or alternatively, the Pendulum Test Method includes a step of dipping the shaving razor into water. For example, the shaving razor is dipped for 30 seconds into deionized water, which is at room temperature, about 70 degrees Fahrenheit. With such a step, the damping can be in a range of about 0.02 N*mm*s/degree to about 0.1 N*mm*s/degree, preferably about 0.04 N*mm*s/degree.

Without intending to be bound by theory, it is believed that damping can be impacted by a variety of aspects. As the pod rotates with respect to the frame about the first axis of rotation, contact between portions of the pod and frame can impact the damping. For example, contact between the projection(s) of the base of the pod to the corresponding aperture (s) can impact the damping because a high amount of friction between these structures results in reduced oscillatory behavior and can be characterized by more rapid decay of oscillations or even elimination of oscillatory behavior. Contact points between other portions of the rotating part (i.e. the pod or cartridge) to frame or handle can also impact damping. In one embodiment, one or more of these contact points can be designed to have increased or decreased friction to impact damping. Additionally, without intending to be bound by any theory, increasing the amount twist of wings of a cantilever tail relative to the preloaded neutral position is one way to increase damping. Additionally, one or more of the contacting surfaces can be textured or lubricated to further control the damping. Various forms of texturing can be used, including but not limited to random stimpling, sand papered effect, raised or depressed lines which can be parallel, cross hatched or in a grid.

Another way to control damping can be to control the amount of pressure between contacting portions of the pod and the frame. Further increasing or decreasing the area of contact between the moving parts can also impact damping.

In another embodiment, specific combinations of materials can be selected such that the friction between the structures can be increased or decreased. For example, combinations of low and or higher coefficient of friction materials can be selected based on the desired amount of fiction.

In one embodiment, the pod inertias range from about 0.2 kg-mm$^2$ to about 1 kg-mm$^2$, or from about 0.3 kg-mm$^2$ to about 0.75 kg-mm$^2$, or from about 0.4 kg-mm$^2$ to about 0.5 kg-mm$^2$, When the cartridge is attached to pod, the total inertia of the cartridge-pod combination range from about 0.7 kg-mm$^2$ to about 3.5 kg-mm$^2$, or from about 0.9 kg-mm$^2$ to about 2 kg-mm$^2$, or from about 1.0 to about 1.3 kg-mm$^2$. In one embodiment, the total inertia of pod and cartridge is about 1.1 kg-mm$^2$.

In one embodiment, the distance from the first axis of rotation 26 to at least one of a) the center of the cartridge in an at rest position, and b) the center of the second axis of rotation 34 that is substantially parallel to the blades 32 can range from about 8 mm to about 18 mm, or between about 12 mm to about 17 mm, or between about 13.8 mm to about 15.8 mm. These dimensions are shown in FIG. 18. This distance can be understood as the cartridge moment arm 310. As this distance can be varied, understanding the damping and/or inertia of the retention system can be aided by calculating the damping to cartridge moment arm ratio and the inertia to moment arm ratio. In an embodiment, the damping to moment arm ratio of can be in a range of about 0.00023 N*s/degree to about 0.023 N*s/degree, preferably about 0.0031 N*s/degree. In another embodiment, the inertia of the pod to moment arm ratio can be in a range of about 0.015 kg-mm to about 0.077 kg-mm, preferably about 0.038 kg-mm. In yet another embodiment, the total inertia of the pod and cartridge to moment arm ration can be in a range of about 0.054 kg-mm to about 0.277 kg-mm, preferably about 0.085 kg-mm.

In one embodiment, the cantilever tail is formed from stainless steel, e.g., 301 stainless steel. The steel can be half-hardened up to full-hard, e.g., up to 850 MPa yield. The steel can also have a modulus of about 200 GPa. To form the cantilever tail from steel, the tail can be cut from a steel sheet in a direction parallel to the grain of steel (e.g., the rolling direction). The tail can have various dimensions of shapes. In an embodiment, the tail can have a height H in a range of about 2.2 mm to about 2.7 mm, preferably about 2.28 mm to about 2.6 mm, and even more preferably about 2.54 mm. The tail can have a length (measured from the portion of the tail exposed out of the base of the pod) in a range of about 16.5 mm to about 18.8 mm, preferably about 17 mm to about 18.5 mm, and even more preferably about 17.16 mm. The tail can have a thickness T in a range of about 0.1 mm to about 0.3, preferably about 0.2 mm. The bar can be twisted about 5 degrees to about 10 degrees when the pod is in the at rest position, preferably about 8 degrees.

When a pod is coupled to a frame, based on the materials of the pod and the frame and the dimensions and engagement of these components, various properties of the entire rotatable system provide insight regarding how a razor of the present invention more closely follows skin contours. Some properties of the rotatable system include stiffness (e.g., primarily stiffness of the pod during slow and fast rotation), damping (e.g., control of rotation due to friction of the pod relative to the frame), and inertia (e.g., amount of torque needed to generate rotation). Without intending to be bound by any theory, it is believed that understanding these properties and/or values of a rotatable system can be useful to understand even across different configurations or geometries of a shaving razor. In an embodiment of the present invention, one manner to understand these properties across different geometries is to understand the properties against a moment arm. For example, one skilled in the art would understand the properties by determining the stiffness to moment arm ratio, the inertia to moment arm ratio, the damping coefficient to moment arm ratio, and combinations thereof.

The frame, pod, ejector button assembly, docking station, and/or blade cartridge unit are configured for simplification of assembly, for example, in high-speed manufacturing. Each component is configured to automatically align and to securely seat. In an embodiment, each component engages to another component in only a single orientation such that the components cannot be inaccurately or imprecisely assembled. Further, each component does not need an additional step of dimensional tuning or any secondary adjustment in manufacturing to ensure proper engagement with other components. The design of the handle also provides control and precision. For example, when the razor is assembled, the pod and/or the blade cartridge unit is substantially centered, the preload of the cantilever tail and/or the perpendicular bar of the pod is controlled precisely over time even after repeated use, and the performance of the cantilever tail, for example, acting as a spring, is controlled, consistent, and robust.

In another embodiment of the present invention where a retention system other than the cantilever tail is used, the device can still have a similar amount of stiffness and/or damping. Examples of these alternative retention systems include those described in U.S. Patent Publ. Nos. 2009/066218, 2009/0313837, and 2010/0043242. In another embodiment, where the handle has an axis of rotation which allows for twisting or torsional rotation, the retention system can still have a similar stiffness and damping relationship. A non-limiting example of such a handle is available in U.S. Patent Publ. No. 2010/0313426.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as “40 mm” is intended to mean “about 40 mm.”

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. Embodiments according to the invention may also combine elements or components of that are disclosed in general but not expressly exemplified in combination unless otherwise stated herein. It is therefore intended to cover in the appended claims all such changes and modifications that are within the scope of this invention.

What is claimed is:

1. A razor comprising:

a cartridge comprising a blade; and a handle coupled to the cartridge by a blade cartridge connecting assembly such that the cartridge is configured to rotate about a first axis substantially parallel to the blade, the handle comprising:

a first end;

a second end opposite the first end; and a rotatable portion coupled to the second end such that the rotatable portion is configured to rotate relative to the first end and about a second axis substantially perpendicular to the blade and the first axis, wherein the rotatable portion comprises a base and a retention system, the retention system with the second end is configured to apply a resistance torque upon the rotatable portion when the rotatable portion is rotated from an at rest position, wherein a portion of the rotatable portion between the first axis and the second axis defines a cartridge moment arm and the retention system has a static stiffness as determined by a Static Stiffness Method such that a ratio of the static stiffness to the moment arm is about 0.05 N/degree to about 1.2 N/degree.

2. The razor of claim 1, wherein the retention system comprises: a cantilever tail extending from the base, a distal end of the cantilever tail retained by the second end of the handle, wherein the cantilever tail generates said torque upon rotation of the rotatable portion about the second axis.

3. The razor of claim 2, wherein the second end defines at least one aperture therethrough and wherein the base comprises at least one projection extending therefrom, the at least one aperture of the second end configured to receive the at least one projection of the base.

4. The razor of claim 2, wherein the second end further comprises a pair of walls retaining the distal end of the cantilever tail.

5. The razor of claim 4, wherein the pair of walls comprises a first wall and a second wall that are offset such that the first wall and the second wall are substantially parallel and non-coplanar.

6. The razor of claim 5, wherein the second end further comprises a cradle, wherein the cradle, the first wall, and the second wall are integrally formed.

7. The razor of claim 1, wherein the cartridge moment arm has a length dimension from about 13 mm to about 15 mm.

8. The razor of claim 1, wherein the ratio is about 0.085 N/degree.

9. A razor comprising:

a cartridge comprising a blade; and a handle coupled to the cartridge by a blade cartridge connecting assembly such that the cartridge is configured to rotate about a first axis substantially parallel to the blade, the handle comprising:

a first end;

a second end opposite the first end; and a rotatable portion coupled to the second end such that the rotatable portion is configured to rotate relative to the first end and about a second axis substantially perpendicular to the blade and the first axis, wherein the rotatable portion comprises a base and a retention system and wherein the retention system with the second end is configured to apply a resistance torque upon the rotatable portion when the rotatable portion is rotated from an at rest position, wherein a portion of the rotatable portion between the first axis and the second axis defines a cartridge moment arm and the rotatable portion has a damping value as determined by a Pendulum Test Method such that a ratio of the damping value to the moment arm is about 0.0005 N*sec/degree to about 0.02 N*sec/degree and the retention system has a static stiffness as determined by a Static Stiffness Method such that a ratio of the static stiffness to the moment arm is about 0.05 N/degree to about 1.2 N/degree.

10. The razor of claim 9, wherein the ratio of the static stiffness to the moment arm is about 0.085 N/degree.

11. The razor of claim 9, wherein a ratio of an inertia of the rotatable portion to the moment arm is about 0.013 kg-mm to about 0.067 kg-mm.

12. The razor of claim 9, wherein the retention system comprises: a cantilever tail extending from the base, a distal end of the cantilever tail retained by the second end of the handle, wherein the cantilever tail generates said torque upon rotation of the rotatable portion about the second axis.

13. The razor of claim 12, wherein the second end defines at least one aperture therethrough and wherein the base comprises at least one projection extending therefrom, the at least one aperture of the second end configured to receive the at least one projection of the base.

14. The razor of claim 12, wherein the second end further comprises a pair of walls retaining the distal end of the cantilever tail.

15. The razor of claim 14, wherein the pair of walls comprises a first wall and a second wall that are offset such that the first wall and the second wall are substantially parallel and non-coplanar.

16. The razor of claim 15, wherein the second end further comprises a cradle, wherein the cradle, the first wall, and the second wall are integrally formed.

17. The razor of claim 9, wherein the moment arm has a length dimension from about 13 mm to about 15 mm.

18. A razor comprising:

a cartridge comprising a blade; and a handle coupled to the cartridge by a blade cartridge connecting assembly such that the cartridge is configured to rotate about a first axis substantially parallel to the blade, the handle comprising:

a first end;

a second end opposite the first end; and a rotatable portion coupled to the second end such that the rotatable portion is configured to rotate relative to the first end and about a second axis substantially perpendicular to the blade and the first axis, wherein the rotatable portion comprises a base and a retention system and wherein the retention system with the second end is configured to apply a resistance torque upon the rotatable portion when the rotatable portion is rotated from an at rest position, wherein a portion of the rotatable portion between the first axis and the second axis defines a cartridge moment arm and the retention system has a static stiffness as determined by a Static Stiffness Method such that a ratio of the static stiffness to the moment arm is about 0.05 N/degree to about 1.2 N/degree and a ratio of an inertia of the rotatable portion to the moment arm is about 0.013 kg-mm to about 0.067 kg-mm.

* * * * *